US012102218B2

(12) United States Patent
Goodloe, Sr.

(10) Patent No.: US 12,102,218 B2
(45) Date of Patent: Oct. 1, 2024

(54) WEARABLE SUPPORT ASSEMBLY FOR CARRYING AN ELECTRONIC DEVICE OR OTHER ITEM IN A FUNCTIONAL POSITION

(71) Applicant: Mark Goodloe, Sr., Kokomo, IN (US)

(72) Inventor: Mark Goodloe, Sr., Kokomo, IN (US)

( * ) Notice: Subject to any disclaimer, the term of this patent is extended or adjusted under 35 U.S.C. 154(b) by 0 days.

(21) Appl. No.: 17/863,526

(22) Filed: Jul. 13, 2022

(65) Prior Publication Data

US 2023/0380578 A1 Nov. 30, 2023

Related U.S. Application Data

(60) Provisional application No. 63/221,733, filed on Jul. 14, 2021.

(51) Int. Cl.

| | |
|---|---|
| ***F16M 13/04*** | (2006.01) |
| ***A45F 3/14*** | (2006.01) |
| ***A45F 5/00*** | (2006.01) |
| *A45F 3/00* | (2006.01) |

(52) U.S. Cl.

CPC ..... *A45F 5/00* (2013.01); *A45F 3/14* (2013.01); *A45F 2003/003* (2013.01); *A45F 2003/146* (2013.01); *A45F 2200/0516* (2013.01); *A45F 2200/0525* (2013.01)

(58) Field of Classification Search

CPC ..... A45F 3/14; A45F 3/04; A45F 2200/0525; A45F 2200/0516; F16M 13/04; G06F 1/163; Y10S 224/93; A47B 23/002

See application file for complete search history.

(56) References Cited

U.S. PATENT DOCUMENTS

| | | | | |
|---|---|---|---|---|
| 4,863,124 | A * | 9/1989 | Ball | F16M 11/048 248/458 |
| 5,667,114 | A | 9/1997 | Bourque | |
| 5,724,225 | A | 3/1998 | Hrusoff et al. | |
| 5,938,096 | A | 8/1999 | Sauer et al. | |
| 6,006,970 | A | 12/1999 | Piatt | |
| 6,076,787 | A | 6/2000 | Troyer | |
| 6,349,864 | B1 | 2/2002 | Lee | |
| 6,381,127 | B1 | 4/2002 | Maddali et al. | |
| 7,591,401 | B2 | 9/2009 | Sandler | |
| 7,780,049 | B1 | 8/2010 | Baranoski | |
| 8,109,421 | B2 | 2/2012 | McLean et al. | |
| 8,267,294 | B2 | 9/2012 | Yu et al. | |
| 8,505,790 | B2 | 8/2013 | Yu et al. | |

(Continued)

FOREIGN PATENT DOCUMENTS

| | | | |
|---|---|---|---|
| EP | 2886930 | B1 | 6/2015 |
| WO | 2022087545 | A1 | 4/2002 |
| WO | WO2015123354 | A1 | 8/2015 |

*Primary Examiner* — Adam J Waggenspack

(74) *Attorney, Agent, or Firm* — John Rizvi; John Rizvi, P.A.—The Patent Professor@

(57) ABSTRACT

A support assembly suitable to be fastened to a user's body to hold or support a laptop computer or other electronic device, or item, in a functional position for the user may include a harness assembly. A support structure may be carried by the harness assembly. When the harness assembly is secured to the user's body, the support structure may extend forwardly from the harness assembly in front of the user. The user may stand or walk as he or she comfortably operates the laptop computer or other item supported on the support structure.

8 Claims, 20 Drawing Sheets

(56) References Cited

U.S. PATENT DOCUMENTS

| | | | | |
|---|---|---|---|---|
| 8,807,406 | B1 * | 8/2014 | Thach | A45C 11/00 224/257 |
| 9,004,330 | B2 | 4/2015 | White | |
| 9,140,406 | B2 * | 9/2015 | Simon | F16M 11/105 |
| 9,411,371 | B1 | 8/2016 | Goren | |
| 9,504,300 | B1 | 11/2016 | Donahue | |
| 9,510,662 | B1 * | 12/2016 | Bruns | A45F 5/021 |
| 9,690,327 | B2 | 6/2017 | Kielland | |
| 10,317,941 | B2 | 6/2019 | Janowski et al. | |
| 11,013,317 | B2 * | 5/2021 | Huang | A47B 23/042 |
| 2002/0074370 | A1 | 6/2002 | Quintana et al. | |
| 2004/0200870 | A1 | 10/2004 | Haber | |
| 2007/0164987 | A1 * | 7/2007 | Graham | H04M 1/05 345/7 |
| 2009/0127309 | A1 | 5/2009 | Wilcox | |
| 2009/0159630 | A1 | 6/2009 | Ko | |
| 2009/0272779 | A1 * | 11/2009 | Vu | A47B 23/002 224/265 |
| 2010/0116860 | A1 * | 5/2010 | Tello | A45F 3/04 361/679.55 |
| 2011/0127304 | A1 | 6/2011 | Kam | |
| 2012/0068044 | A1 | 3/2012 | Rivera | |
| 2012/0175396 | A1 * | 7/2012 | Patino | F16M 13/00 248/690 |
| 2013/0214115 | A1 | 8/2013 | Yu | |
| 2015/0124385 | A1 * | 5/2015 | Mak | F16M 13/04 361/679.05 |
| 2017/0068270 | A1 | 3/2017 | Kielland | |
| 2018/0098616 | A1 | 4/2018 | Ianotta | |

* cited by examiner

WEARABLE SUPPORT ASSEMBLY FOR CARRYING AN ELECTRONIC DEVICE OR OTHER ITEM IN A FUNCTIONAL POSITION

CROSS-REFERENCE TO RELATED APPLICATION

This application claims the benefit of U.S. Provisional Patent Application No. 63/221,733, filed on Jul. 14, 2021, which is incorporated by reference herein in its entirety.

FIELD OF THE INVENTION

The present invention relates generally to laptop computers, and more particularly, to a support assembly which can be fastened or secured to a user's body to hold or support a laptop computer in a functional position.

BACKGROUND OF THE INVENTION

Over the last several decades, portable electronic devices have become increasingly popular. Conventional portable electronic devices may include smartphones, tablet computers, portable electronic gaming devices, and laptop computers. Portable electronic devices have the capacity to store and process large quantities of information in a compact and lightweight manner.

Some types of personal electronic devices can be easily held by the hands. For this reason, these devices have become extremely popular for a variety of applications. Prolonged use of these devices, however, may cause discomfort.

Laptop and notebook computers are a type of personal electronic device which has become commonplace in a variety of applications. For example, medical personnel may maintain charts and other data relating to patient care. Medical professional may carry a laptop into an exam room and place the laptop on a table, desk, countertop, or other support surface to enable the personnel to use the laptop. In another example, journalists, engineers, attorneys, teachers, and other professionals may be required to write numerous emails throughout the day.

A laptop or notebook computer typically includes a keyboard which is connected to a display screen via a hinge or other connection. The laptop or notebook computer further includes a central processing unit (CPU), a memory, and one or more batteries to provide electrical power to the computer. The keyboard enables the user of the computer to input data and commands into the CPU, whereas the display screen presents data processed by the CPU. A mouse or other input device may be connected to the computer via a wired or wireless connection.

In some applications, laptop or notebook computers may be used in a wide variety of tasks in which a desk or other support for the computer may not be available. For example, some applications of laptop computers may require that the operator of the computer stand or walk during computer use. In some cases, medical personnel may need to be near the patient while using the laptop at a location in which a suitable support surface for the laptop may not be available. Accordingly, the medical personnel may be required to support the laptop using one hand while typing or entering data into the laptop using the other hand. Consequently, data entry errors and a reduction in efficiency may occur. Personnel in other fields may also find the use of laptops beneficial but may, at times, lack a suitable support surface for the laptop during its use.

Accordingly, there is need for a solution to at least one of the aforementioned problems. For example, there remains a need for an easy-to-use and convenient solution which allows a user to operate their portable electronic device(s) while standing or walking.

SUMMARY OF THE INVENTION

The present invention is directed to a support assembly which can be fastened around the body of a user to hold or support a laptop computer or other electronic device, or item, in a functional position for the user. The support assembly may include a harness assembly. The harness assembly may be configured for fastening to the body of a user of a laptop computer or other electronic device, a book, or other applicable items. For example, the harness assembly, may be configured for fastening around the waist and/or shoulders of the user. A support structure may be supported by the harness assembly. The support structure may be configured to support the laptop computer or other item. In an exemplary application, the harness assembly may be fastened around the waist and/or shoulders of the user. The support structure may extend forwardly from the harness assembly in front of the user. The user may stand or walk as he or she comfortably operates the laptop computer or other item supported on the support structure. In some embodiments, the support structure may be longitudinally and transversely adjustable.

In an illustrative implementation, a support assembly which can be fastened to a user's body to hold or support a laptop computer or other electronic device, or item, in a functional position for the user may include a harness assembly. The harness assembly may be configured to be selectively fastened to the user's body. A support structure may be carried by the harness assembly. The support assembly may be positionable in a first configuration in which the harness assembly is fastened to the body of a user and carries the support structure on a front side of the body of the user, and the support structure provides a coplanar support for resting an electronic device or other item thereon.

In a second aspect, in the first configuration of the support assembly, the coplanar support may be arranged along a generally horizontal plane.

In another aspect, in the first configuration of the support assembly, the coplanar support may be adjustably positionable relative to the harness assembly.

In another aspect, the support structure may be formed along a front-to-back longitudinal direction and a left-to-right transverse direction. In the first configuration of the support assembly, the support structure may extend generally frontward of the harness assembly and body of the user.

In another aspect, the support structure may include a tray. The tray may include a base providing the coplanar support. The base may include at least one flange configured to prevent the electronic device or other item supported on the base from sliding off the base in the first configuration of the harness assembly.

In yet another aspect, in the first configuration of the support assembly, the support structure may be transversely expandable to vary a width of the support structure.

In another aspect, in the first configuration of the support assembly, the support structure may be longitudinally movable to vary a distance between the support structure and the harness assembly and body of the user.

In another aspect, the support assembly may further include a counterforce member configured to abut against a back of the user. The counterforce member may be configured to counteract the weight of the support structure and electronic device or other item supported thereon in the first configuration of the harness assembly, to maintain a position of the support structure and electronic device or other item supported thereon.

In another aspect, the support assembly may further include selectively extendable and retractable, first and second arms. The first and second arms may be pivotably attached to the counterforce member and configured to pivot relative to the counterforce member along opposite sides of the user's body. Each of the first and second arms may include and pivotably carry respective, two or more elongate members. In the first configuration of the support assembly, the first and second arms may be extended and protrude frontward of the user's body in spaced-apart relationship with one another, with the two or more elongate members of the first arm and the two or more elongate members of the second arm pivoted towards each other providing the coplanar support.

In yet another aspect, the arms may be selectively extendable and retractable from the counterforce member in a left-to-right, transverse direction.

In another aspect, the support structure may include a first panel and a second panel pivotably carried by the first panel. The second panel may be pivotable between a closed position, in which the second panel is pivoted upward, and an inner side of the second panel faces and is adjacent to an outer side of the first panel, and an open position, in which the second panel may be pivoted downward and away from the first panel.

In the first configuration of the support assembly, the second panel may be arranged in the open position and the inner side of the second panel may provide the coplanar support.

In another aspect, in the first configuration of the support assembly, the first panel may rest on the user's body.

In another aspect, in the open position, the second panel may form about 90 degrees with the first panel.

In yet another aspect, with the second panel arranged in the closed position, a gap may be provided between the first and second panels. The gap may be configured to receive the electronic device or other item.

In another aspect, the support structure may further include an arm and an electronic device mount carried by the arm. The arm may be pivotable relative to the first panel.

In another aspect, the first and second panels may be pivotably connected to one another by a hinge. The arm may extend from the hinge.

In another aspect, the arm may be arranged between the first and second panels.

In yet another aspect, the arm may be extendable and retractable. In the first configuration of the support assembly, the arm may be extended outward and frontward of the second panel and carries the electronic device mount frontward of the second panel. The support assembly may be alternatively positionable in a second configuration, in which the second panel may be arranged in the closed position and a gap may be provided between the first and second panels. In the second configuration, the arm may be retracted, and the arm and electronic device mount may be received within the gap. The gap may be configured to receive an electronic device mounted on the electronic device mount.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
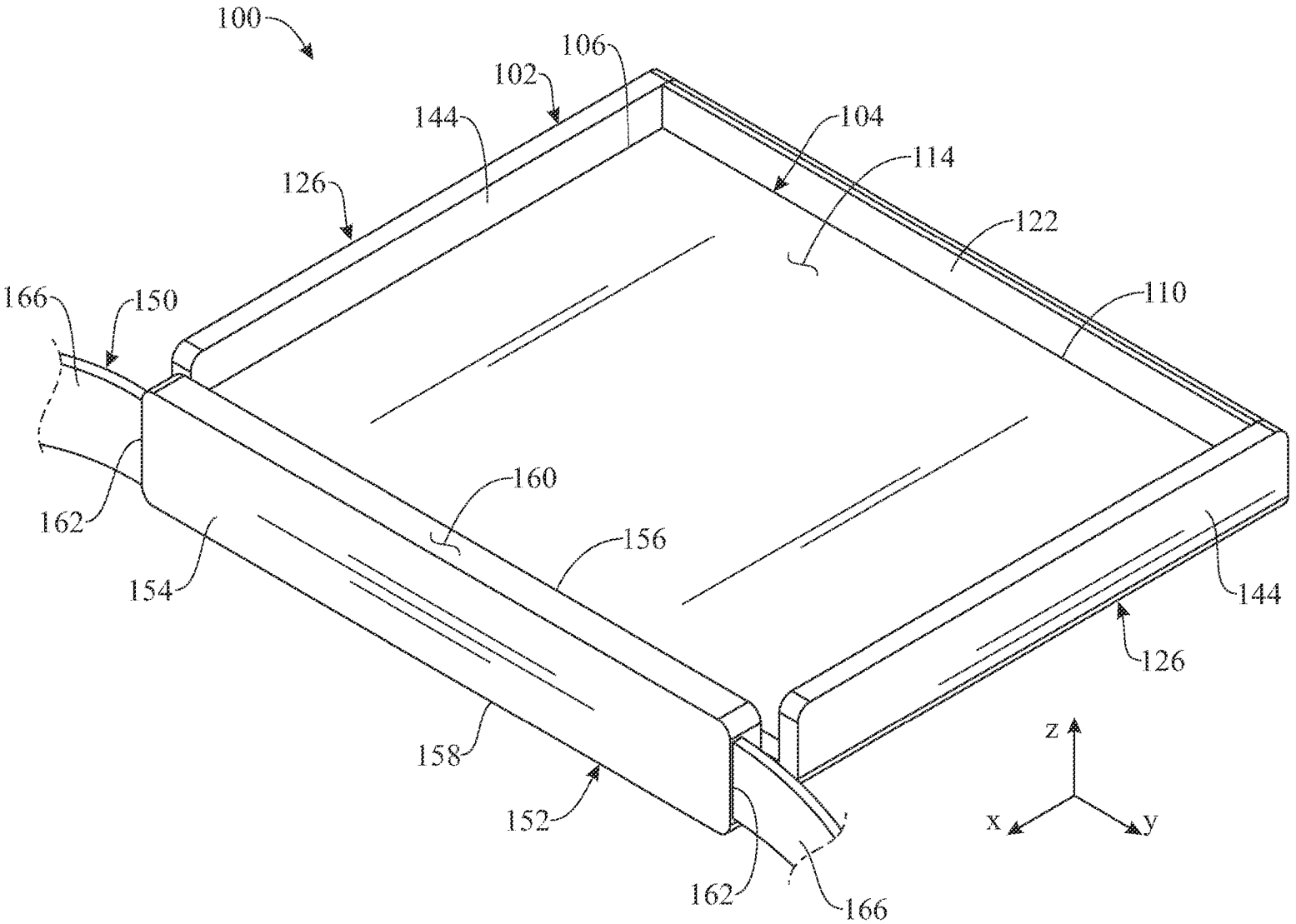
FIG. 1 presents a rear perspective view of a support assembly in accordance with a first illustrative embodiment of the present invention, with the support strap of the harness assembly shown partially in section.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward a support assembly which can be secured to the body of a user to hold or support a laptop computer in a functional position for the user.

Figure 3:
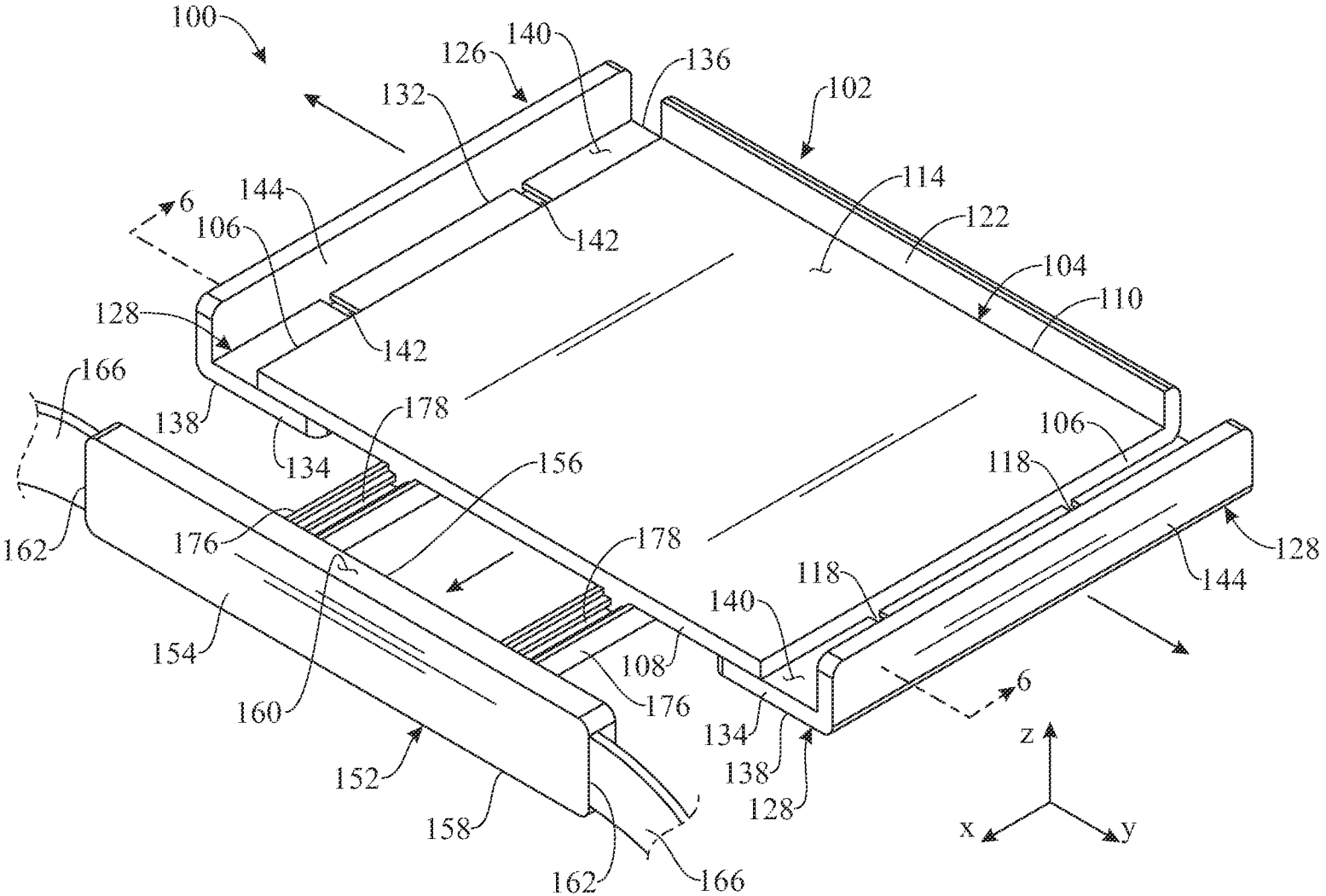
FIG. 3 presents a perspective view of the support assembly illustrated in FIG. 1, with the support structure deployed in an extended position relative to the harness assembly in an illustrative application of the support assembly.
Figure 4:
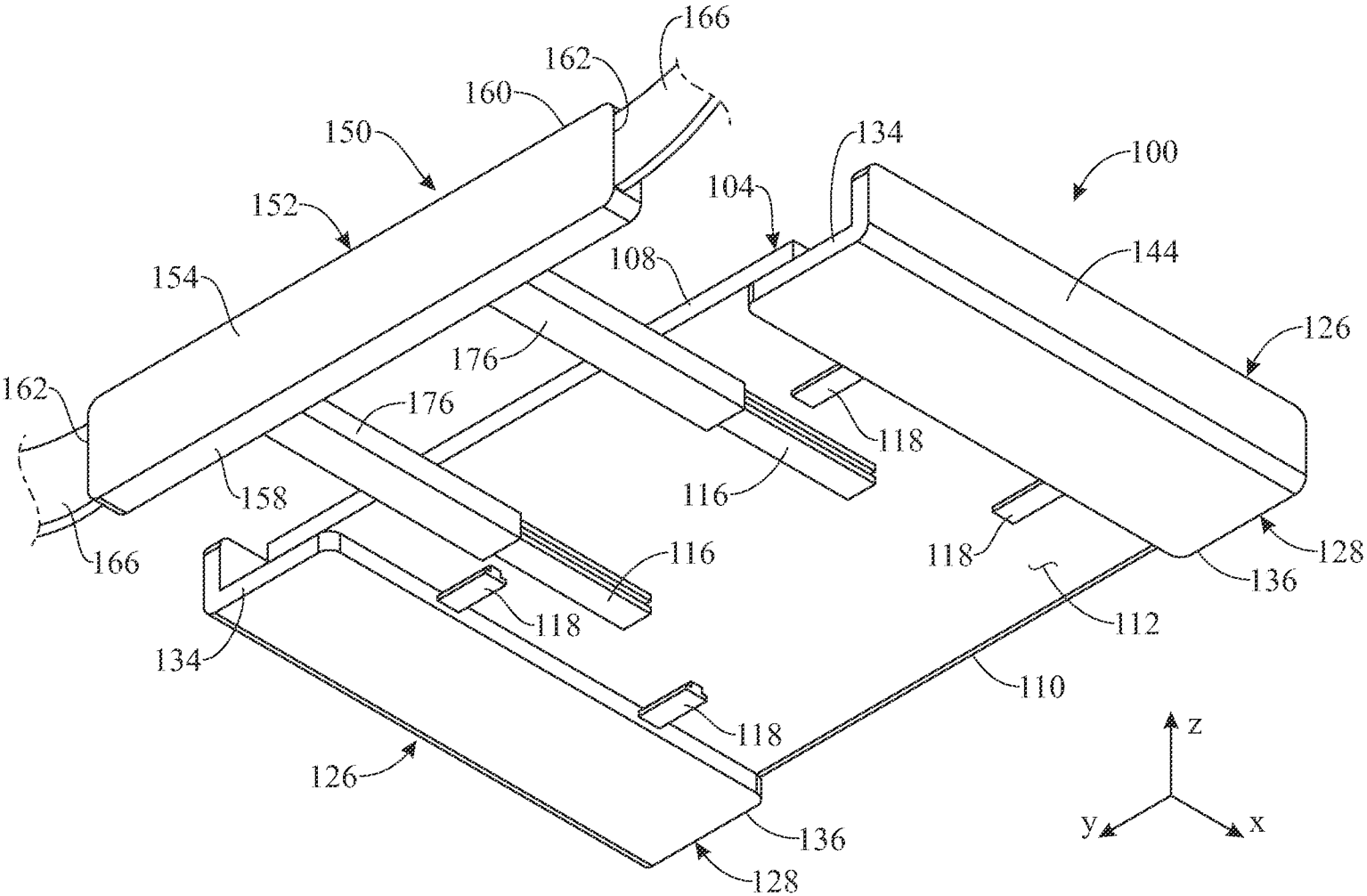
FIG. 4 presents a bottom perspective view of the support assembly illustrated in FIG. 3.
Figure 5:
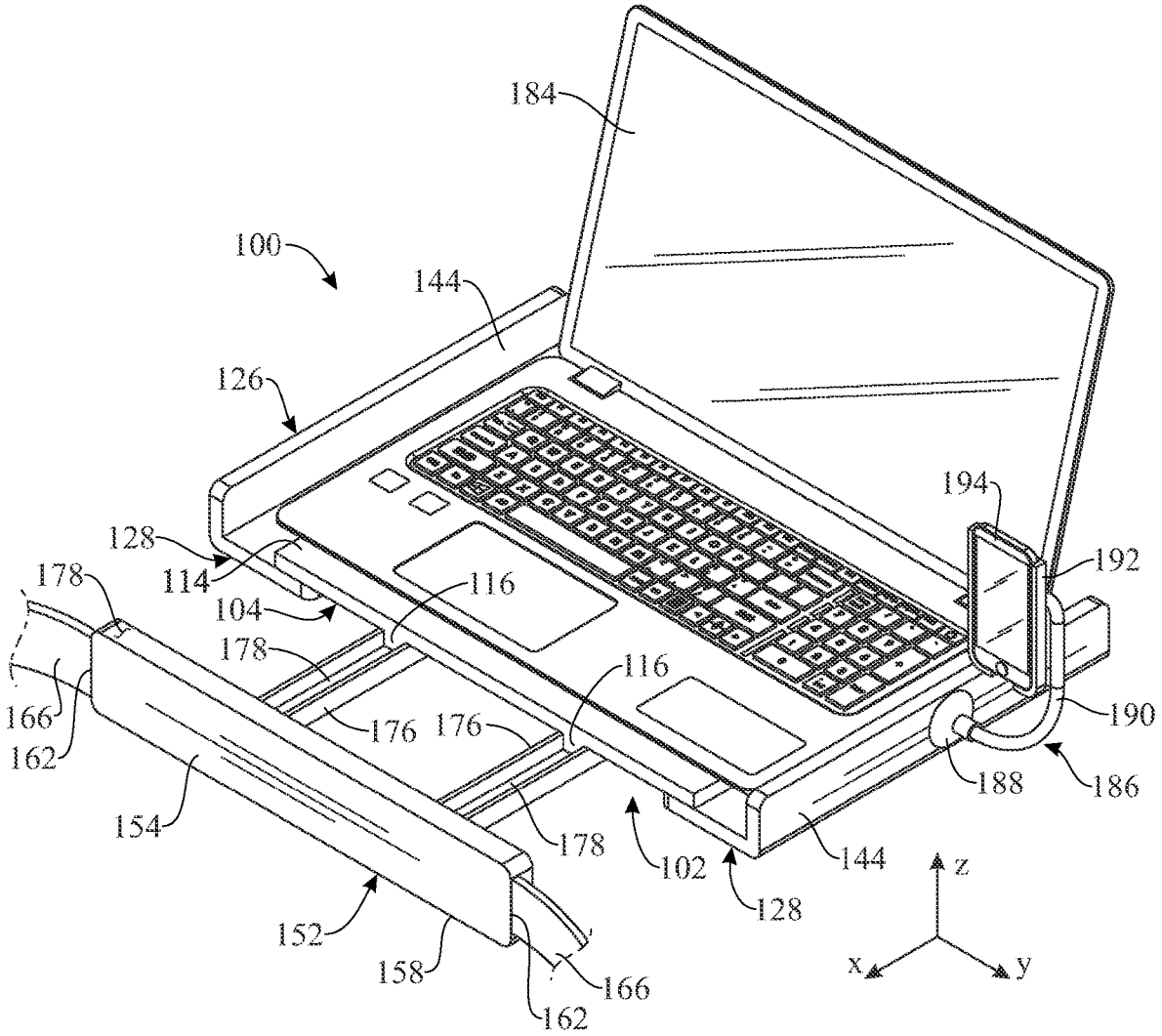
FIG. 5 presents a rear perspective view of the support assembly illustrated in FIG. 1, with a laptop computer resting on the support structure in an illustrative application of the support assembly.
Figure 6:
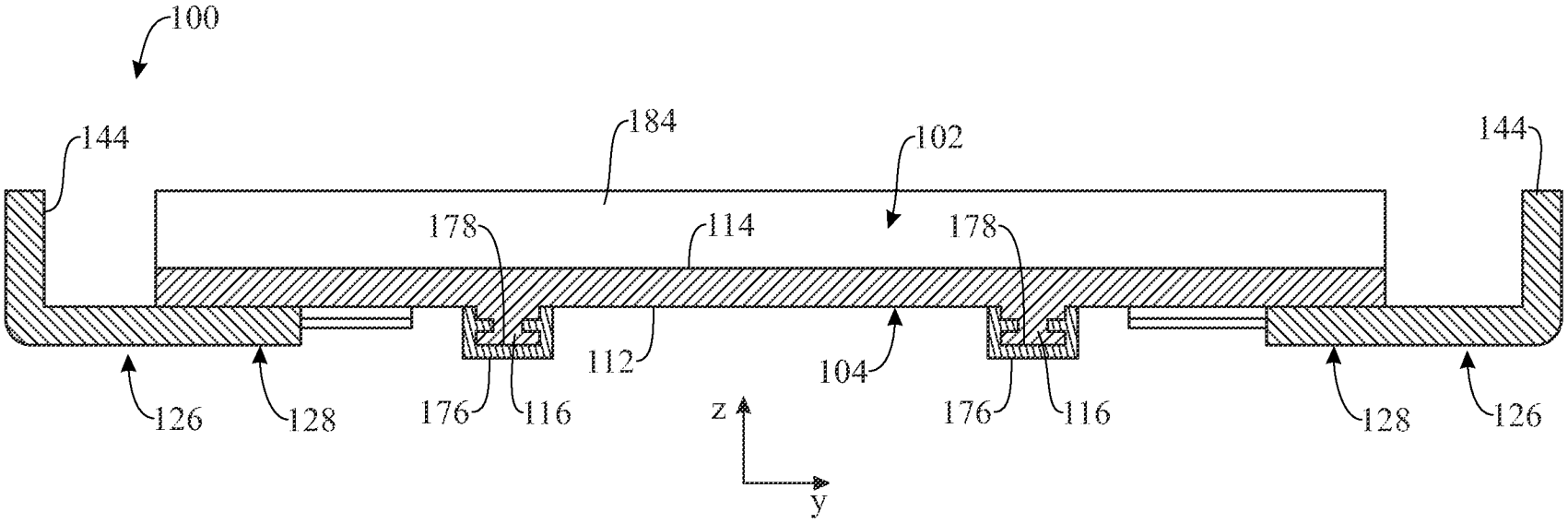
FIG. 6 presents a cross-sectional view, taken along section lines 6-6 in FIG. 3, of the support assembly.
Figure 7:
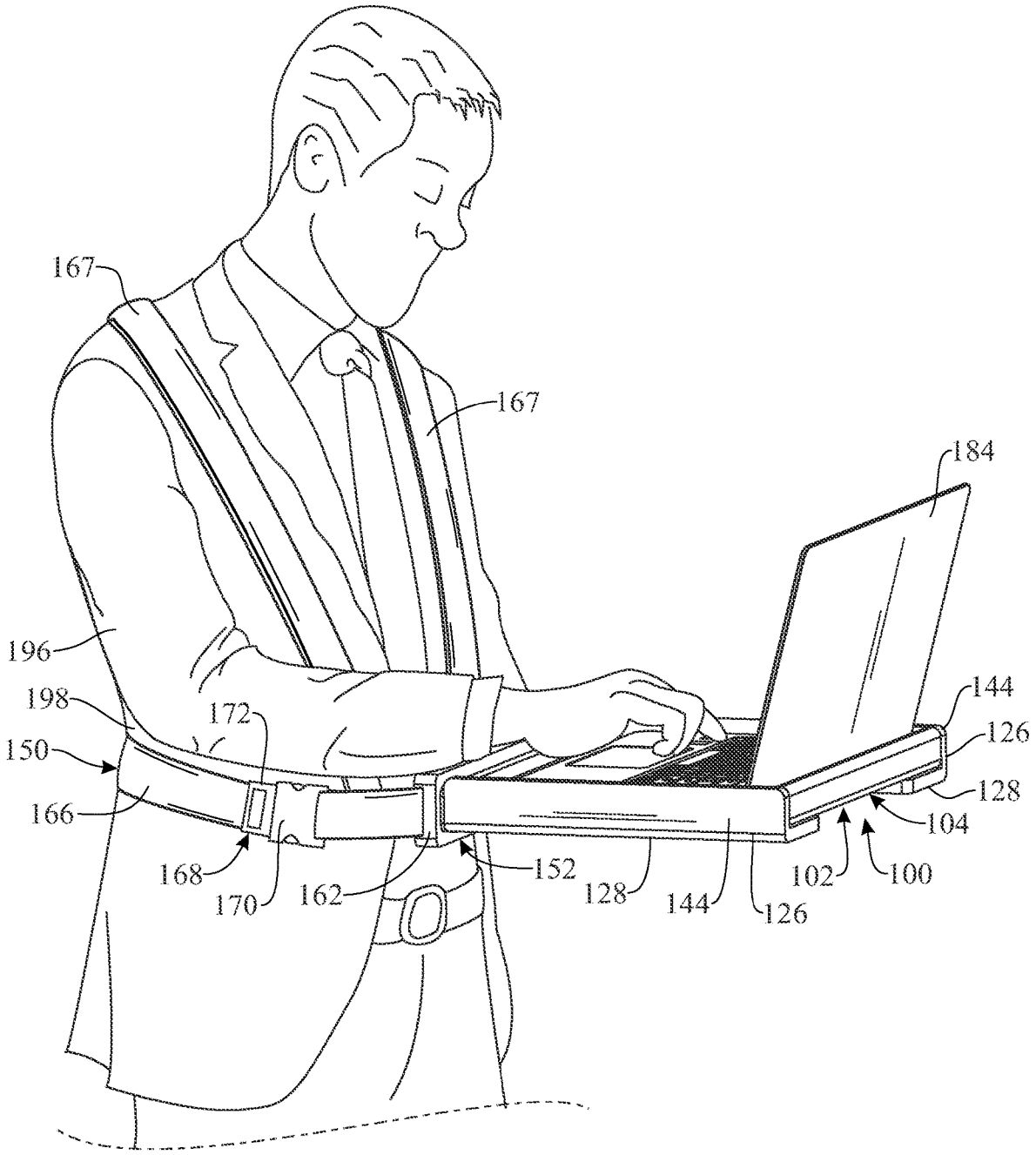
FIG. 7 presents a side perspective view of the support assembly, with the harness assembly deployed in place on the waist of a laptop user, with a laptop computer supported on the support structure as the user operates the laptop computer.

Referring initially to FIGS. 1-7, a support assembly 100 is illustrated in accordance with a first exemplary embodiment of the present invention. As shown for instance in FIGS. 1 and 7, the support assembly 100 may include a harness assembly 150. A support structure 102 may be attached to and supported by the harness assembly 150. As illustrated in FIG. 7, the harness assembly 150 of the support assembly 100 may be suitably configured to be fastened to a waist 198 and/or other areas of the body a user 196 of a laptop computer 184. As illustrated in FIGS. 5 and 7, the support structure 102 of the support assembly 100 may be configured to support the laptop computer 184 in a position in which the laptop user 196 can easily access and manipulate or operate the laptop computer 184 as the laptop user 196 stands or walks.

Figure 2:
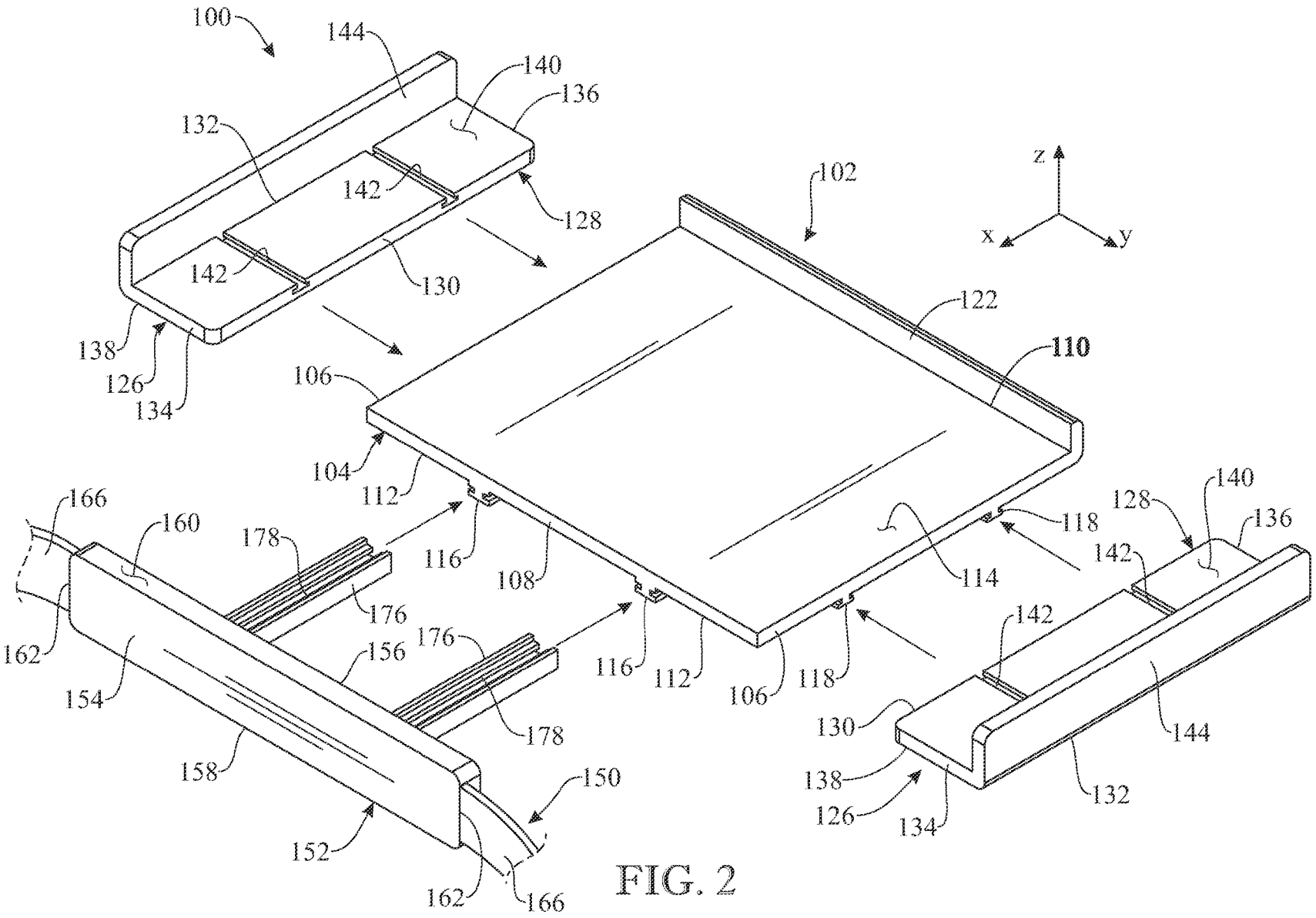
FIG. 2 presents an exploded perspective view of the support assembly illustrated in FIG. 1.

In some embodiments, the harness assembly 150 may include a base 152, best shown in FIG. 2. At least one support strap 166 may extend from the base 152. As best shown in FIG. 7, the support strap(s) 166 may be suitably configured to be releasably fastened around the waist 198 of the laptop user 196. Alternatively or additionally to the waist strap 166, the support assembly 100 may include one or more shoulder straps 167 configured to secure the support device 100 to the user's shoulder area. The present embodiment, for instance, includes both a waist strap 166 and shoulder straps 167, and more specifically, a pair of shoulder straps 167 extending from the waist strap 166 at opposite sides of the base 152. At least one releasable strap fastener 168 may be provided in the support strap 166. In some embodiments, the strap fastener 168 may include at least one buckle receptacle 170 and at least one buckle tab 172 which is releasably insertable in the buckle receptacle 170 to removably secure the harness assembly 150 to the user's body.

As illustrated in FIGS. 1-4, in some embodiments, the base 152 of the harness assembly 150 may be elongately formed along a left-to-right or transverse direction y. In some embodiments, the base 152 may be generally flat or plate-shaped, with a rear surface 154, a front surface 156, a lower surface 158, a upper surface 160 and a pair of opposite ends 162. The support strap 166 may extend from the respective ends 162 of the base 152. In preferred embodiments, the base 152 may be generally rigid.

As shown for instance in FIG. 2, the support structure 102 of the present embodiment is configured as a tray, and may include a bottom tray wall or base 104 configured to support the electronic device. At least one flange 122 may extend upward (e.g., vertically upward) from the base 104. At least one side retainer 126 may engage one or more of the transverse (left and right) sides of the base 104. For instance, the present embodiment includes a respective side retainer 126 on each of the left and right sides of the base 104. The side retainers 126 and flange 122 may be configured to retain the laptop computer 184 on the base 104 of the support structure 102, by preventing the laptop computer 184 from sliding off in the transverse direction y, in a front-to-back or longitudinal direction x, or in a direction which is a combination of the longitudinal and transverse directions x and y, respectively, in a manner which will be hereinafter described.

With continued reference to FIG. 2, in some embodiments, the base 104 of the support structure 102 may be rectangular. The base 104 may have a pair of elongated, parallel, spaced-apart side edges 106. A rear edge 108 and a front edge 110 may extend between the side edges 106 in parallel, spaced-apart relationship to each other. A lower surface 112 (FIG. 4) and an upper surface 114 may extend from the side edges 106, the rear edge 108 and the front edge 110. In some embodiments, the flange 122 may extend from the upper surface 114 along the front edge 110, as illustrated.

The support structure 102 may be mounted on the base 152 of the harness assembly 150. Preferably, the support structure 102 is movably mounted on the base 152 such that a separation between the base 152 and the support structure 102 in the longitudinal direction x is adjustable, such as to bring the laptop computer 184 closer or farther from the user's body, to accommodate laptop computers 184 of different lengths, and/or to accommodate additional items (e.g., a notepad, a cup, etc.). In one non-limiting example, as illustrated in FIG. 2, at least one, and more preferably, at least two support rails 176 may extend from the base 152 of the harness assembly 150 in the longitudinal direction x. Each support rail 176 may have at least one longitudinally elongated rail groove 178. In turn, at least one, and more preferably, a pair of elongated rails 116 may extend from the lower surface 112 of the base 104 along the longitudinal direction x. Each rail 116 may extend generally from the rear edge 108 to the front edge 110 of the base 104 and between and parallel to the side edges 106 of the base 104. Each rail 116 may slidably engage the rail groove 178 in each corresponding support rail 176 of the harness assembly 150. As illustrated in FIGS. 3 and 4, the base 104 may be slidable on the support rails 176 in the longitudinal direction x, towards and away from the base 152 to accommodate laptop computers 184 having various depths, as will be hereinafter described. The rail grooves 178 and corresponding rails 116 may be configured such that they interlock with one another to both permit a longitudinal movement and prevent a vertical movement (i.e. along vertical direction z) relative to one another; for instance, the rail grooves 178 and rails 116 may have a T-shaped (as shown), H-shaped, tongue-and-groove, or other interlocking geometry.

As illustrated in FIGS. 2 and 3, in some embodiments, the side retainers 126 may engage the respective side edges 106 of the base 104. At least one, and more preferably, both side retainers 126 may be movable relative to the base 104 in the transverse direction y, such as to accommodate laptop computers 184 of different widths, and/or to accommodate additional items (e.g., a notepad, a cup, a mousepad, etc.). In some embodiments, at least one side retainer base rail 118 may extend from the lower surface 112 of the base 104. At least one rail groove 142 may be provided in each side retainer 126. Each side retainer base rail 118 may slidably engage each corresponding rail groove 142 to facilitate selective adjustment of the position of each side retainer 126 relative to the corresponding side edge 106 of the base 104, as illustrated in FIGS. 3 and 4. The rail grooves 142 and corresponding side retainer base rails 118 may be configured such that they interlock with one another to both permit a transverse movement and prevent a vertical movement relative to one another; for instance, the rail grooves 142 and side retainer base rails 118 may have a T-shaped (as shown), H-shaped, tongue-and-groove, or other interlocking geometry.

In some embodiments, each side retainer 126 may include a retainer base 128. A flange 144 may extend upward (e.g., vertically upward) from the retainer base 128. The retainer base 128 may be generally elongated and rectangular with an elongated inner edge 130 and an elongated outer edge 132 disposed in parallel, spaced-apart relationship to each other. A rear edge 134 and a front edge 136 may extend between the inner edge 130 and the outer edge 132. The retainer base 128 may be generally flat or plate-shaped, and include a lower surface 138 and an upper surface 140 extending from the inner edge 130, the outer edge 132, the rear edge 134 and the front edge 136. The flange 144 may extend from the upper surface 140 along the outer edge 132 of the retainer base 128 of each corresponding side retainer 126. Each rail groove 142 may extend into the upper surface 140 of the retainer base 128 of each corresponding side retainer 126.

As illustrated in FIGS. 5 and 7, in typical application of the support assembly 100, the support strap 166 and shoulder straps 167 of the harness assembly 150 may be fastened around the waist 198 and shoulders of a laptop user 196 with the support structure 102 extending forwardly from the base 152 in front of the laptop user 196. This may be accomplished by, for example and without limitation, unfastening the strap fastener 168 (FIG. 7); extending the support strap 166 and shoulder straps 167 around the user's waist 198 and shoulders, respectively; and fastening the strap fastener 168. In some embodiments, the support strap 166 and/or shoulder straps 167 may be length adjustable. For instance, the strap fastener 168 may include a strap adjustment mechanism (not illustrated) which facilitates adjustment in the tightness and looseness of the support strap 166.

With reference to FIG. 5, the laptop computer 184 may be placed on the upper surface 114 of the base 104. The rear edge of the laptop computer 184 may be spaced apart from, or engage, the flange 122 of the support structure 102. In some applications, the support structure 102 may initially be slid longitudinally on the support rails 176 away from the laptop user 196 to provide sufficient clearance for and facilitate placement of the laptop computer 184 on the base 104, or for ergonomics and ease of use of the laptop computer 184. As illustrated in FIGS. 3 and 4, if needed or desired, the side retainers 126 may initially be positionally adjusted away from the base 104 of the support structure 102 to facilitate placement of the laptop computer 184 on the base 104, after which the side retainers 126 may be slid toward and into engagement with the respective side edges of the laptop computer 184.

As illustrated in FIG. 7, the laptop user 196 may stand or walk as he or she operates the laptop computer 184. The support assembly 100 supports the laptop computer 184 and frees the hands of the laptop user 196 such that the laptop user 196 is free to operate the laptop computer 184 with both hands. It will be appreciated by those skilled in the art that the support structure 102 securely supports the laptop computer 184 in a cantilever manner as the laptop user 196 applies downward pressure on the keyboard and/or mouse of the laptop computer 184. In some embodiments, as shown in FIG. 4, the rails 116 may extend to half or more than half of the total length (dimension along the longitudinal direction x) of the base 104, and the support rails 176 may be dimensioned to extend to said half or more than half of the total length of the base 104 when base 104 is moved closest to the base 152.

After use of the support assembly 100, the laptop computer 184 may be removed from the support structure 102. The support strap 166 may be unfastened and the support and shoulder straps 166 and 167 removed from the waist 198 and torso of the laptop user 196.

As illustrated in FIG. 5, in some applications, at least one device holder 186 may be deployed on the support structure 102 of the support assembly 100 to hold at least one personal electronic device 194. The personal electronic device 194 may be a smartphone, tablet computer or the like. In some embodiments, the device holder 186 may include a suction cup 188. An elongated, multi-positional holder gooseneck or arm 190 may extend from the suction cup 188. A device carrier 192 may be supported by the holder arm 190. The device carrier 192 may be suitably configured to hold and support at least one personal electronic device 194. The device holder 186 may be deployed by attaching the suction cup 188 to the flange 144 of one of the side retainers 126, for example and without limitation, or any other suitable structural element of the support structure 102. In some applications, the device carrier 192 may be sized and configured to receive and hold a book (not illustrated) in such a position that the laptop user 196 can read the book.

While the support assembly 100 has been depicted supporting a laptop computer 184, it must be noted that the support assembly 100 may be used to alternatively or additionally support other items. For instance, in an advantageous use of the support assembly 100, one of the side retainers 126 may be pulled transversely outward and its upper surface 140 may be used to displace a mouse device therealong. In some applications, a mouse pad may be placed on said upper surface 140; in other embodiments, the upper surface 140 may incorporate a mousepad or mouse compatible surface finish or material. In alternative applications, the support assembly 100 may be used to support a dinner tray (not illustrated) on the support structure 102. Food (not illustrated) may be placed on a plate and/or a bowl (not illustrated) on the dinner tray. As he or she stands, the user 196 may consume the food from the plate or bowl. Other items that may be supported on, and used, with the support assembly 100 may include, for instance and without limitation, an electronic book, tablet, phone or other portable electronic device, a paper book, a notebook, a pen, pencil or other writing implement, etc., or combinations thereof.

Figure 8:
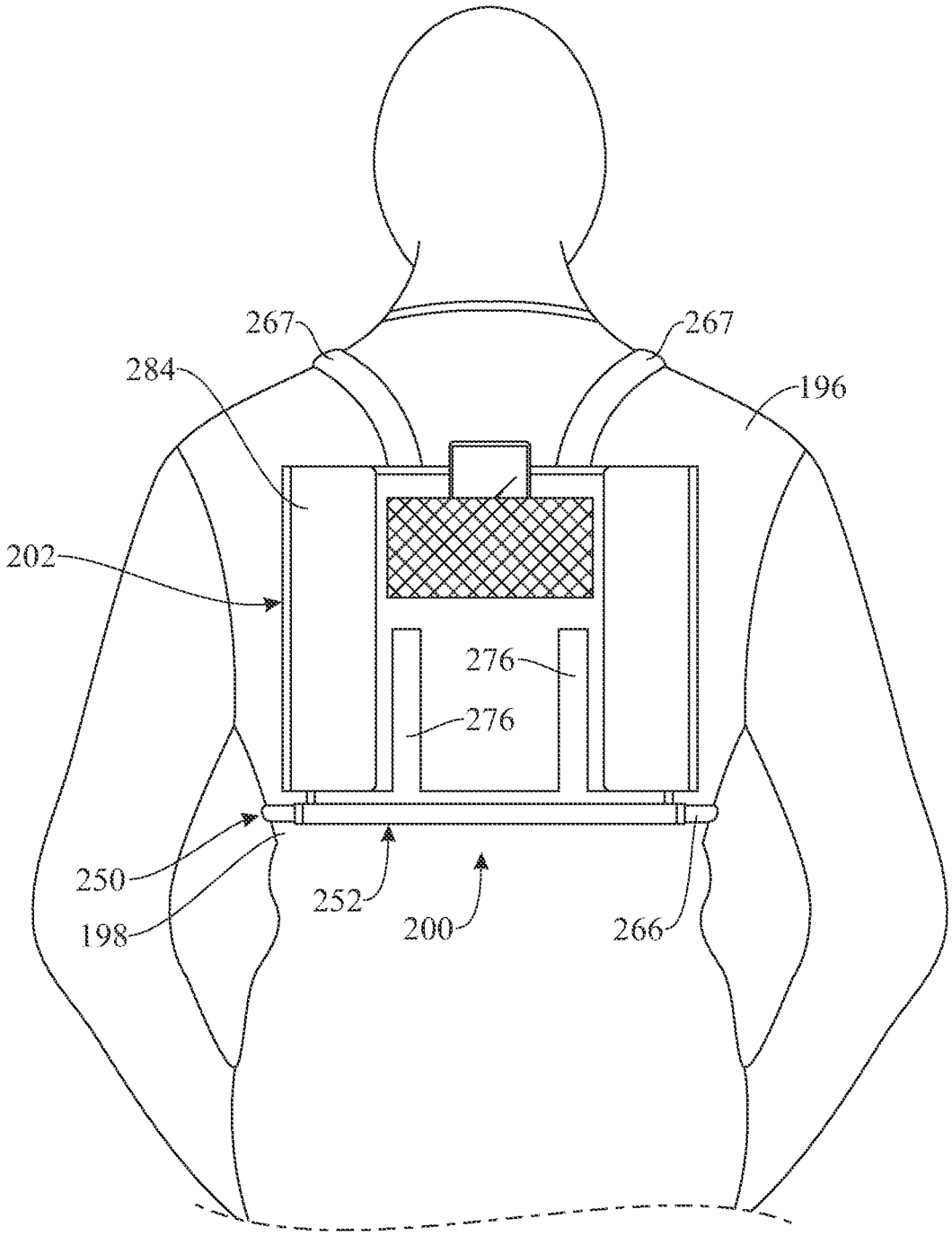
FIG. 8 presents a rear view of an alternative illustrative embodiment of the support assembly, deployed on a laptop user, with the laptop computer deployed on the support assembly, in an illustrative application thereof.

Referring next to FIG. 8, an alternative illustrative embodiment of the support assembly is generally indicated by reference numeral 200. In the support assembly 200, elements which are analogous to the respective elements of the support assembly 100 that was heretofore described with respect to FIGS. 1-6 are designated by the same respective numerals in the 200-299 series in FIG. 8. The support assembly 200 may include a harness assembly 250. In some embodiments, the harness assembly 250 may have a design which is the same as or similar to that of the harness assembly 150 heretofore described with respect to FIGS. 1-7.

A support structure 202 may extend from the harness assembly 250. In some embodiments, the support structure 202 may have a design which is the same as or similar to that of the support structure 102 heretofore described with respect to FIGS. 1-7. The harness assembly 250 may include a pair of shoulder straps 267, which may extend from the support structure 202. The extending or distal ends of the respective shoulder straps 267 may terminate on the harness assembly 250. In an illustrative application of the support assembly 200, the harness assembly 250 may be fastened around the waist of the laptop user 296 by a waist or support strap 266, which may extend from opposite sides of a base 252. The shoulder straps 267 may be extended over the respective shoulders of the laptop user 296. The laptop computer 284 may be placed in the support structure 202 with the support structure 202 positioned across the back of the laptop user 296, and may be held in place by one or more brackets 276.

Turning to FIGS. 9-14, a support assembly 300 is illustrated in accordance with a third exemplary embodiment of the present invention. As shown for instance in FIG. 10, the support assembly 300 may include a harness assembly 350. In some embodiments, the harness assembly 350 may have a design which is the same as or similar to that of the harness assembly 150 heretofore described with respect to FIGS. 1-7. A support structure 302, configured to support an electronic device, may be attached to and carried by the harness assembly 350. The harness assembly 350 may be securable to the user's shoulders, similarly to the previous embodiments, by a set of shoulder straps 367; however, alternative embodiments are contemplated in which the harness assembly 350 may be alternatively or additionally securable to the user's waist and/or other areas of the user's body such that the user may wear the harness assembly 350 and thereby carry the support structure 302 and supported electronic device.

Figure 10:
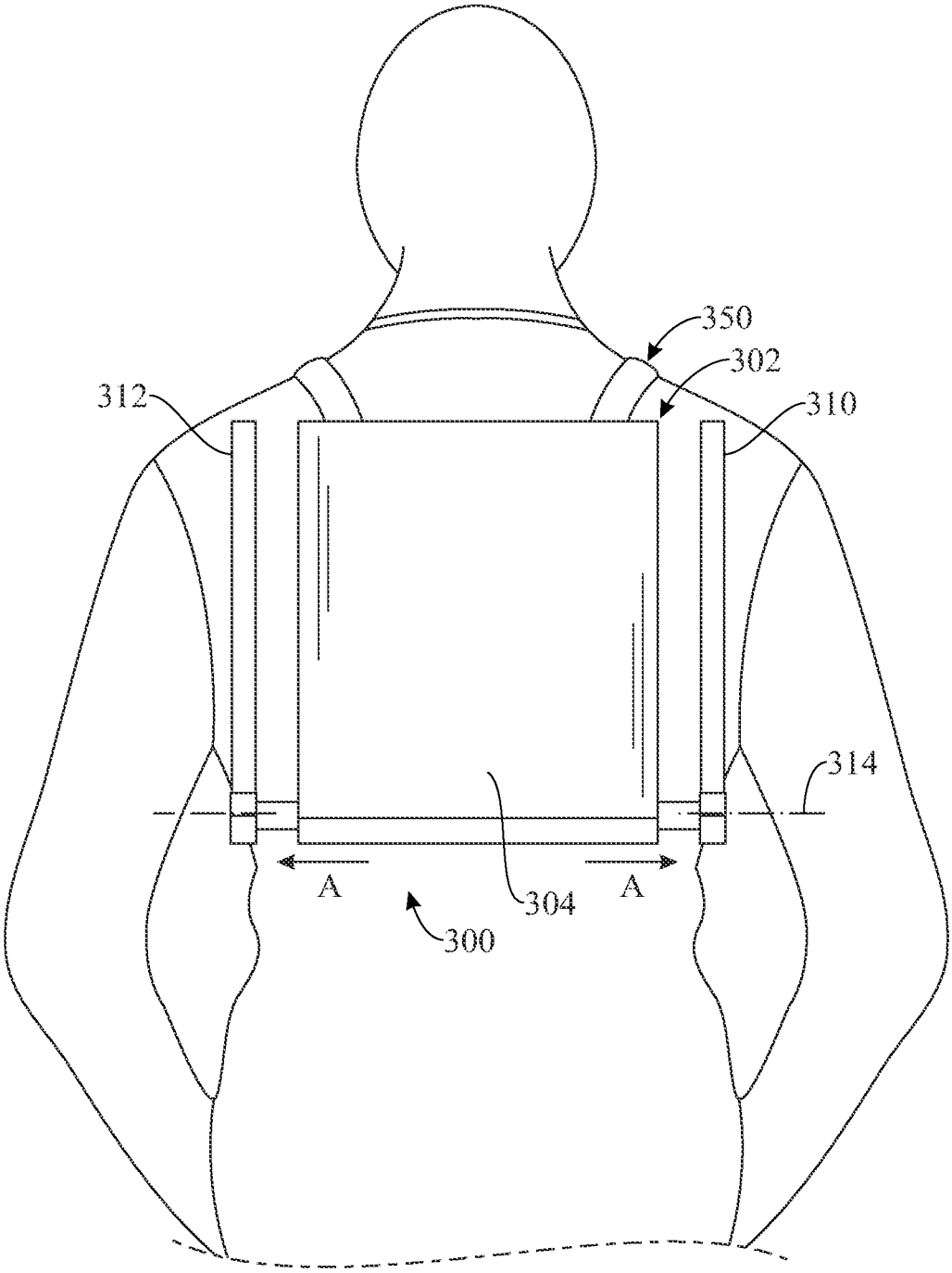
FIG. 10 presents a rear elevation view of the support assembly of FIG. 9 worn by a user, illustrating the arms being pulled out from the transversely retracted position of the previous figure to an extended position.
Figure 11:
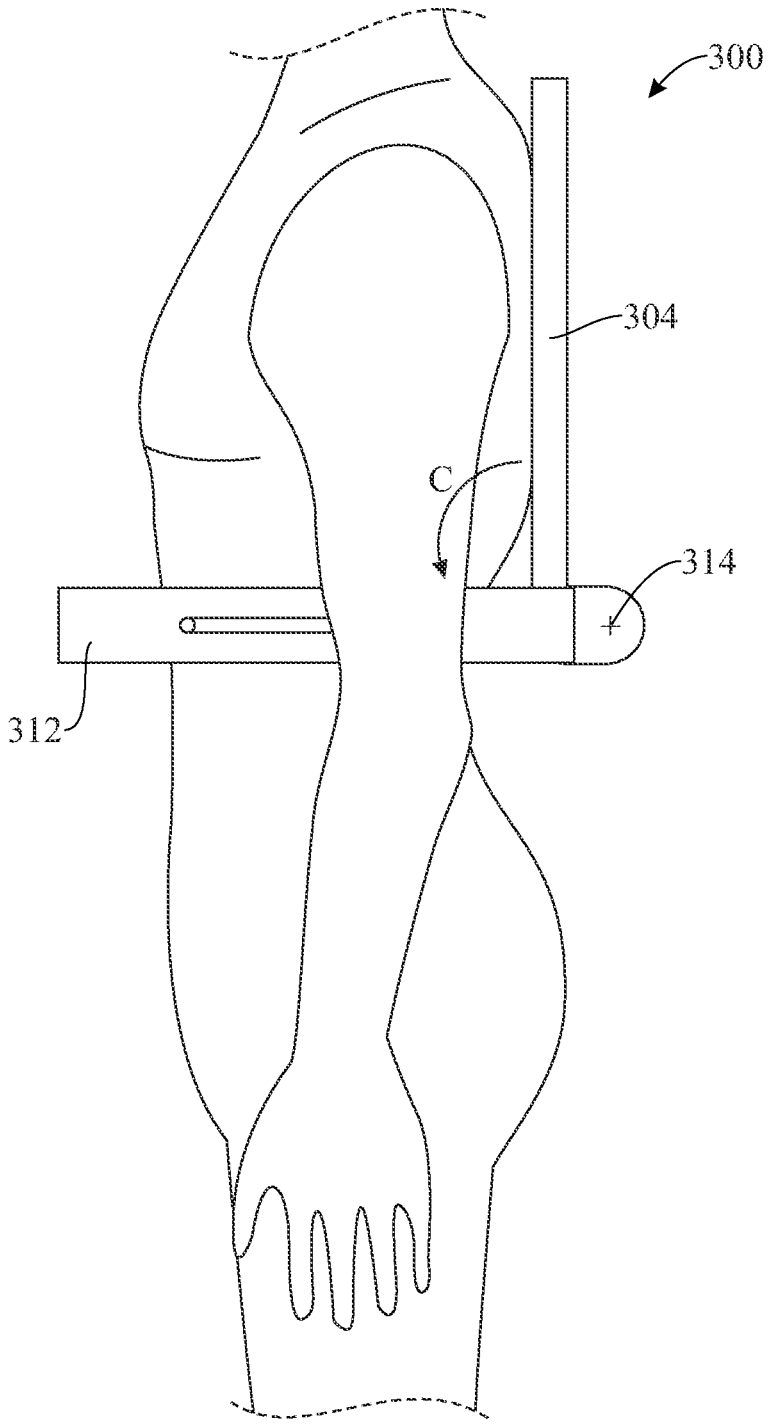
FIG. 11 presents a side elevation view of the user and support assembly of FIG. 10, illustrating the arms being pivoted from the upright position of FIG. 10 to a forwardly oriented, usage position.

The support structure 302 of the present embodiment comprises a rear, counterforce member 304 configured to be positioned in the area of the user's back, as best shown in FIGS. 10 and 11. The counterforce member 304 may be configured to rest on or abut against the user's back such that the counterforce member 304 may provide a counterforce to the weight of the electronic device which helps maintain the electronic device in place when supported on the support structure 302, as will be described in more detail hereinafter. For example, the counterforce member 304 may include a panel or plate, which may be planar, as shown in the drawings. Alternatively or additionally, the counterforce member 304 may include features such as recesses, protrusions, non-planar shapes or contours, or the like, enabling the counterforce member 304 to ergonomically rest against the user's back. Alternatively or additionally, the counterforce member 304 may include cushioning elements configured to interface with the user's back to increase user comfort, etc.

Figure 9:
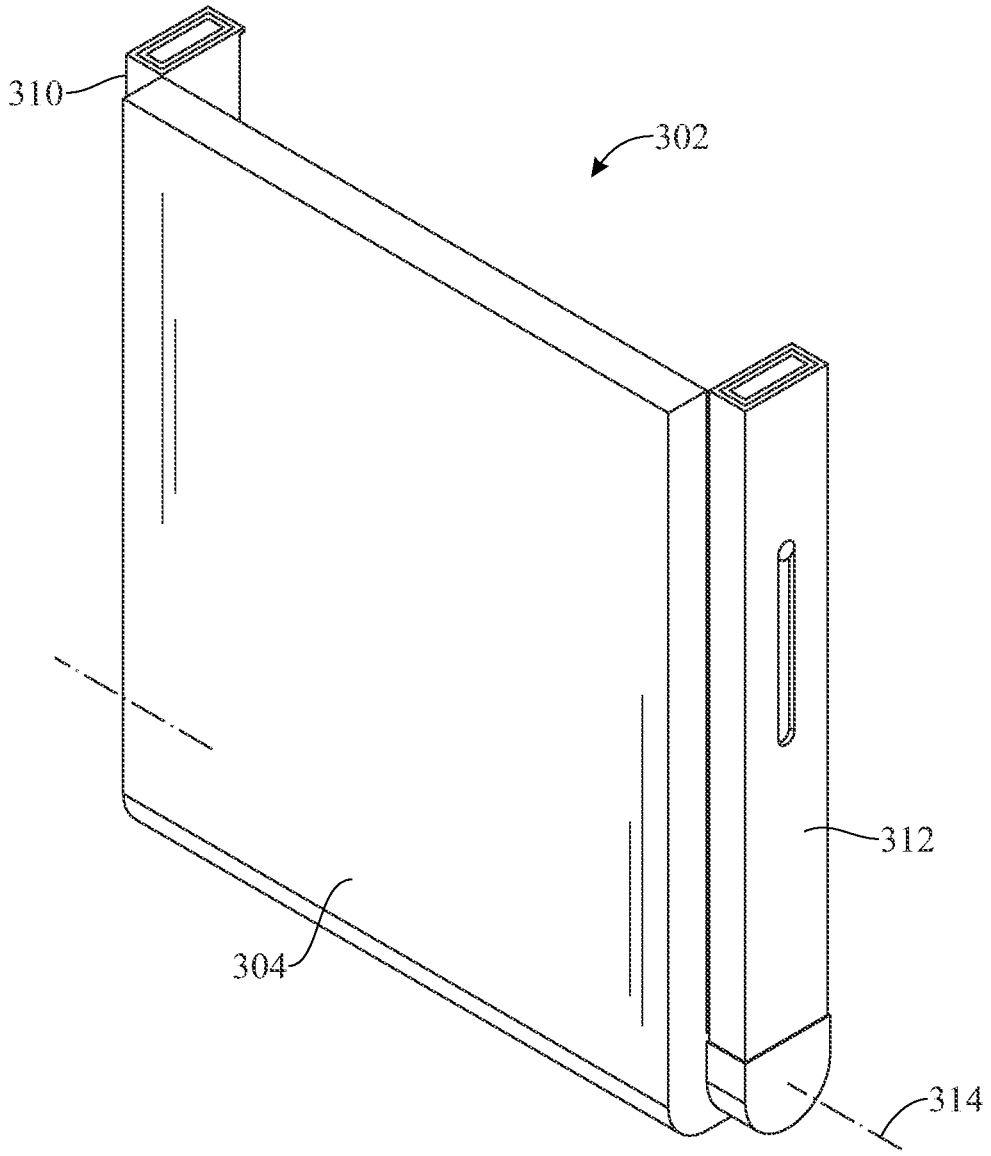
FIG. 9 presents a top, front isometric view of a support assembly in accordance with a third illustrative embodiment of the invention, showing opposite side arms in a pivotally upright, longitudinally compressed, and transversely retracted configuration, such that the arms are arranged adjacent to a counterforce member of the support structure.

As further shown in FIGS. 9 and 10, the support structure 302 may further include a first arm 310 and a second arm 312 which may attached to the counterforce member 304 and may be configured to extend forward from opposite, left and right sides of the counterforce member 304. In some embodiments, one or both of the first and second arms 310 and 312, and preferably both arms 310 and 312, may be pivotable relative to the counterforce member 304, allowing the arms 310 and 312 to pivot between a storage position, such as the upright position shown in FIG. 9, in which the arms 310 and 312 are arranged generally parallel to and along or adjacent to the left and right sides of the counterforce member 304, and a usage position, shown in FIGS. 11-14, in which the arms are pivoted downward relative to the counterforce member 304. In some embodiments, the arms 310 and 312 may be pivotable relative to a left-to-right, transverse rotation axis 314. In some embodiments, the first arm 310 and the second arm 312 may be pivotable independently of one another; in other embodiments, said arms 310 and 312 may be jointly pivotable. In some embodiments, the arms 310 and 312 are blocked or prevented from pivoting downward beyond the usage position, i.e. may not pivot further downward than the usage position of FIGS. 11-14. In some embodiments, the arms 310 and 312 in the usage position may be mechanically blocked for downward pivoting, but may be free to pivot upward; in other embodiments, the arms 310 and 312 in the usage position may be blocked from pivoting upward and downward, and may be unlockable, such as manually, so that the arms can again pivot upward towards the upright position.

As best shown in FIG. 10, in some embodiments, one or both of the first and second arms 310 and 312 are selectively separable from the counterforce member 304 in the left-to-right, transverse direction, as indicated by arrows A, to increase the separation between the first and second arms 310 and 312. This may allow the arms 310 and 312 to be positioned in an extended position in which the separation between the arms 310 and 312 is larger than the user's body width in the area of the arms 310 and 312 when the user is wearing the support assembly 300 as shown in FIG. 3. Thus, the arms 310 and 312 in the extended position may be pivoted forward at opposite left and right sides of the user's body, as best shown in FIG. 11, which depicts the right side of the body and the second arm 312 located at and across said right side (similarly, the first arm 310 would be deployed at and across the opposite, left side of the body). The extendable arm or arms 310, 312 may be retracted oppositely to arrow A, to adopt a retracted position shown in FIG. 9, such as for storage or transportation purposes.

Figure 12:
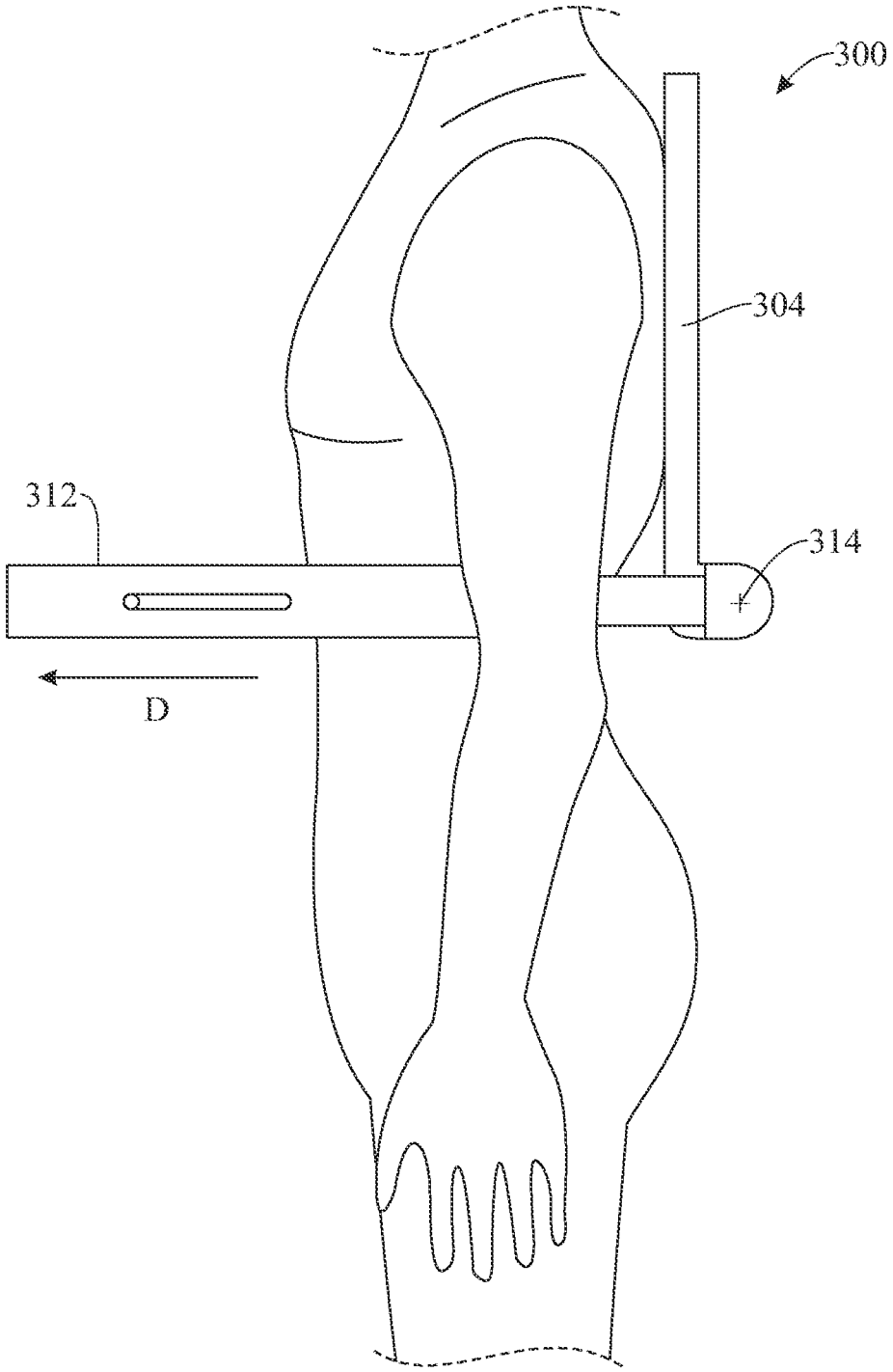
FIG. 12 presents a side elevation view, similar to FIG. 11, illustrating the arms being pulled out from the longitudinally compressed position to a longitudinally extended position.
Figure 13:
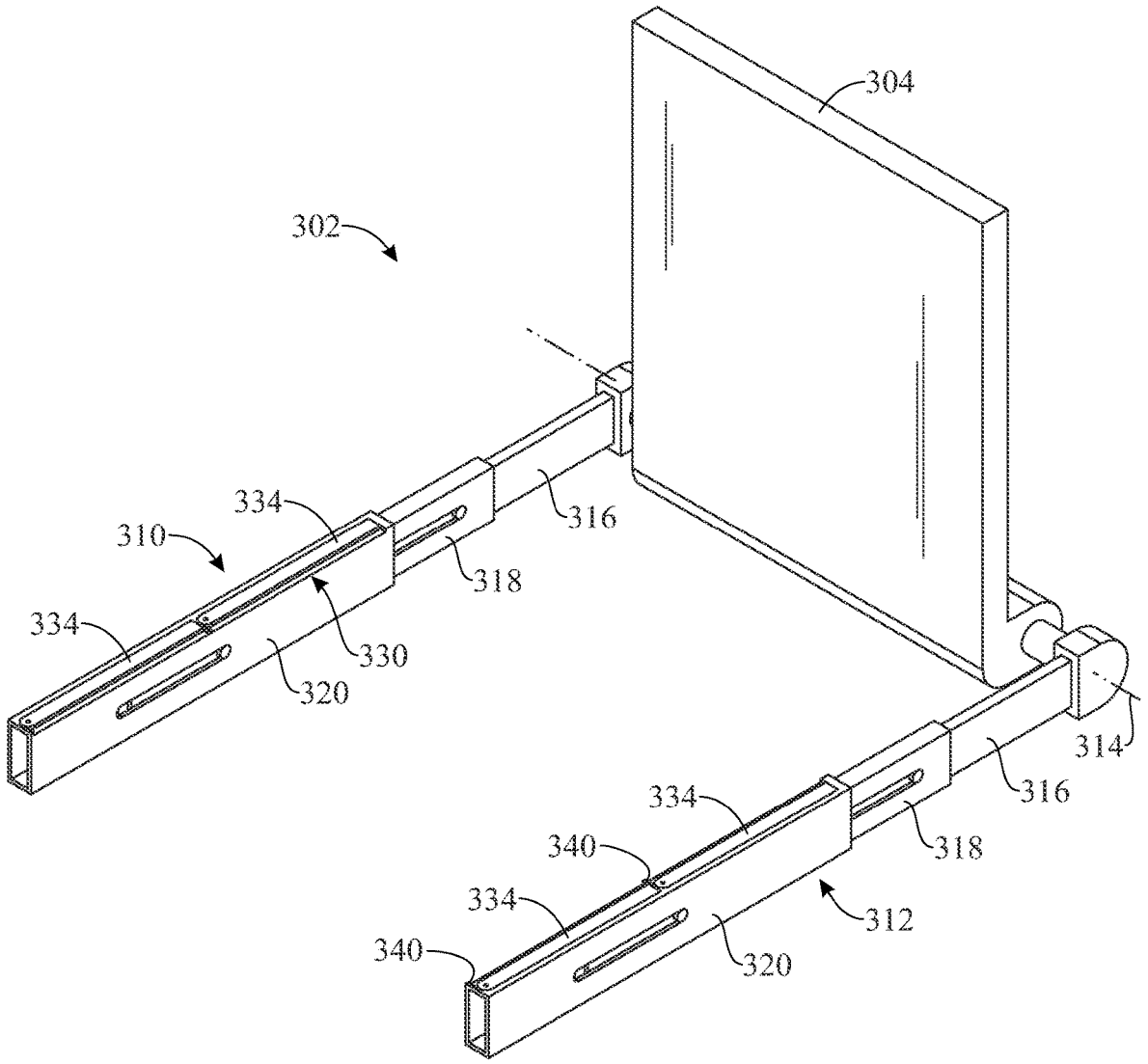
FIG. 13 presents a top, front isometric view of the support structure with the arms in the usage and extended position, further illustrating pivotable elongate members in an initial, collapsed position.

With reference to FIGS. 11-13, in some embodiments, the first arm 310 and/or second arm 312, and preferably both arms 310 and 312, may be length-adjustable, such as telescopically. For example, in the present embodiment, both arms 310 and 312 are telescopically length-adjustable, and may be individually adjusted between a shorter or compressed configuration, shown in FIGS. 9-11, and a longer or extended configuration, shown in FIGS. 12-14. Preferably, the arms 310 and 312 may be length-adjusted to intermediate lengths, between the shorter configuration and the longer configuration. In some embodiments, the arms 310 and 312 may include one or more locking features for securing the arms 310 and 312 at the selected length. In other embodiments, the arms 310 and 312 may relatively freely extend and retract between the shorter and longer configurations. The telescopic first and second arms 310 and 312 of the present embodiment specifically include three respective arm segments 316, 318 and 320 which are telescopically movable relative to one another; however, alternative embodiments are contemplated in which the number of telescopic arm segments in each arm may vary from two to any.

Figure 14:
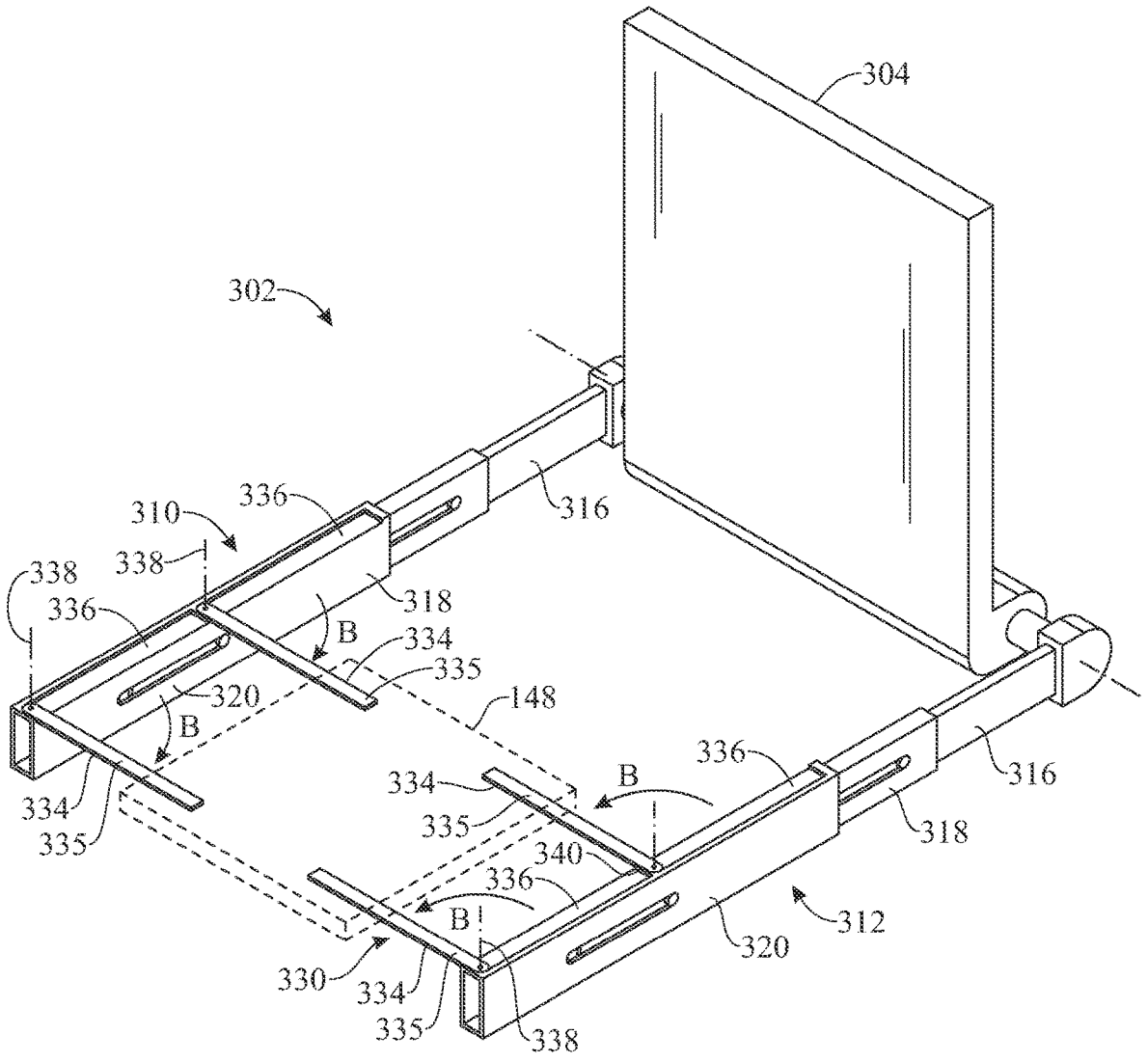
FIG. 14 presents a top, front isometric view, similar to FIG. 13, illustrating the pivoting of the elongate members to a deployed position for supporting a laptop computer or other item thereon.

Furthermore, as shown in FIGS. 13 and 14, the support structure 302 of the support assembly 300 may include a deployable support 330 configured for the resting thereon of an electronic device, such as, but not limited to, a laptop computer 148, a schematical representation of which is shown in phantom lines in FIG. 14. In some embodiments, the deployable support 330 may include a respective set of two or more elongate members 334 carried by each arm 310 and 312. The elongate members 334 are preferably rigid and non-deformable.

The two or more elongate members 334 of each arm 310 and 312 may be pivotable relative to each arm between a collapsed position, shown in FIG. 13, and an expanded position, shown in FIG. 14. In the collapsed position, the elongate members 334 may be pivoted on and into the respective arm 310 and 312 such that, the elongate members 334 do not interfere with the retraction and expansion of the length-adjustable arms 310 and 312 between the shorter or compressed configuration (FIGS. 9-11) and the longer or extended configuration (FIGS. 12-14). For instance, in the non-limiting example shown in the drawings, the elongate members 334 in the collapsed position are received inside respective recesses 336 formed in the arms 310 and 312, such as on a top side of the arms 310 and 312. In some embodiments, each arm 310, 312 may include a separate or independent recess 336 for each elongate member 334, as shown; in other embodiments, the two or more elongate members 334 of each arm 310 and 312 may be received in a common recess 336 formed in said each arm 310 and 312. As further shown, the elongate members 334 may be pivotable relative to the arms 310 and 312 about respective vertical rotation axes 338, i.e. on a horizontal plane as indicated by arrows B.

In the expanded position, shown in FIG. 14, the elongate members 334 are pivoted inward and towards one another, and may be oriented parallel to one another and perpendicular to the arms 310 and 312. Top sides 335 of the elongate members 334 may be arranged preferably coplanar to one another and may provide a stable support for the laptop computer 148 or other electronic device or item. In some embodiments, the top sides 335 may include a non-slip feature such as a rubber or other high-friction material, a texture or rugosity, or the like, to further stabilize the laptop computer 148 on the elongate members 334. As further shown in FIG. 14, in the extended position, the elongated members 334 may be blocked from pivoting further in the direction of arrows B by corresponding stops 340 comprised in the arms 310 and 312.

In an example of operation, a user may fit on the harness assembly 350 as described heretofore, with the counterforce member 304 of the support structure 302 resting on the user's back. The length-adjustable arms 310 and 312 may initially be arranged in the shorter or compressed configuration and may be pivoted to the upright position, as shown in FIG. 9, allowing the user to carry the support assembly 300 around as a backpack. In the event that the user wishes to utilize their laptop computer 148, the user may pull the arms 310 and 312 outward as indicated by arrow A in FIG. 10, subsequently pivot the arms 310 and 312 downward as indicated by arrow C in FIG. 11, and then, if needed, adjust the length of the arms 310 and 312 by extending the arms forward as indicated by arrow D in FIG. 12. The user may pivot the elongate members 334 outward as indicated by arrow B in FIG. 14, such as until the elongate members 334 are stopped by the stops 340, and then place the laptop computer 148 on the top sides 335 of the elongate members 334. After use of the support assembly 300, the laptop computer 184 may be removed from the support structure 302 and the user may collapse the support assembly 300 following the inverse sequence.

Figure 15:
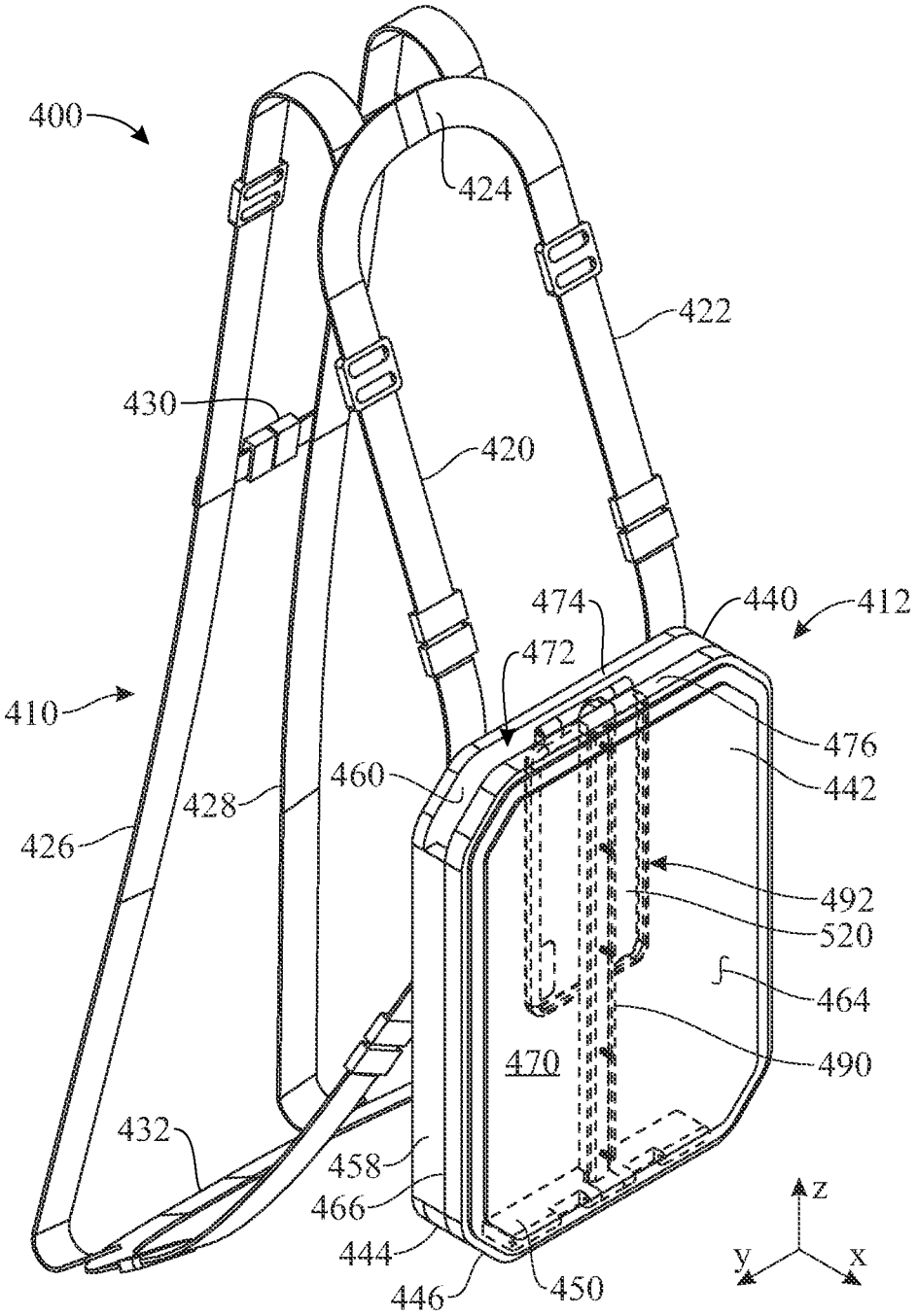
FIG. 15 presents a top, front isometric view of a support assembly in accordance with another embodiment of the present invention, with a second panel shown in a closed position relative to a first panel, and an electronic device mount shown retracted and housed within a gap formed between the first and second panels.

The illustrations of FIGS. 15-20 show a support assembly 400, in accordance with yet another exemplary embodiment of the present invention. Similarly to previous embodiment, the support assembly 400 is suitable to be fastened to a user's body to hold or support an electronic device or other item in a functional position for the user. I.e., the support assembly 400 may support the electronic device or other item in a position in which the user may use or operate the electronic device or other item. With reference initially to FIG. 15, as shown, the support assembly 400 includes a harness assembly 410 and a support structure 412. The harness assembly 410 is configured to be selectively fastened to a body of a user (e.g., body 552 of user 550 shown in FIG. 20), and carries the support structure 412. Via the harness assembly 410, the support structure 412, together with an electronic device or other item supported thereon, may be carried by the user 550 hands-free.

Figure 16:
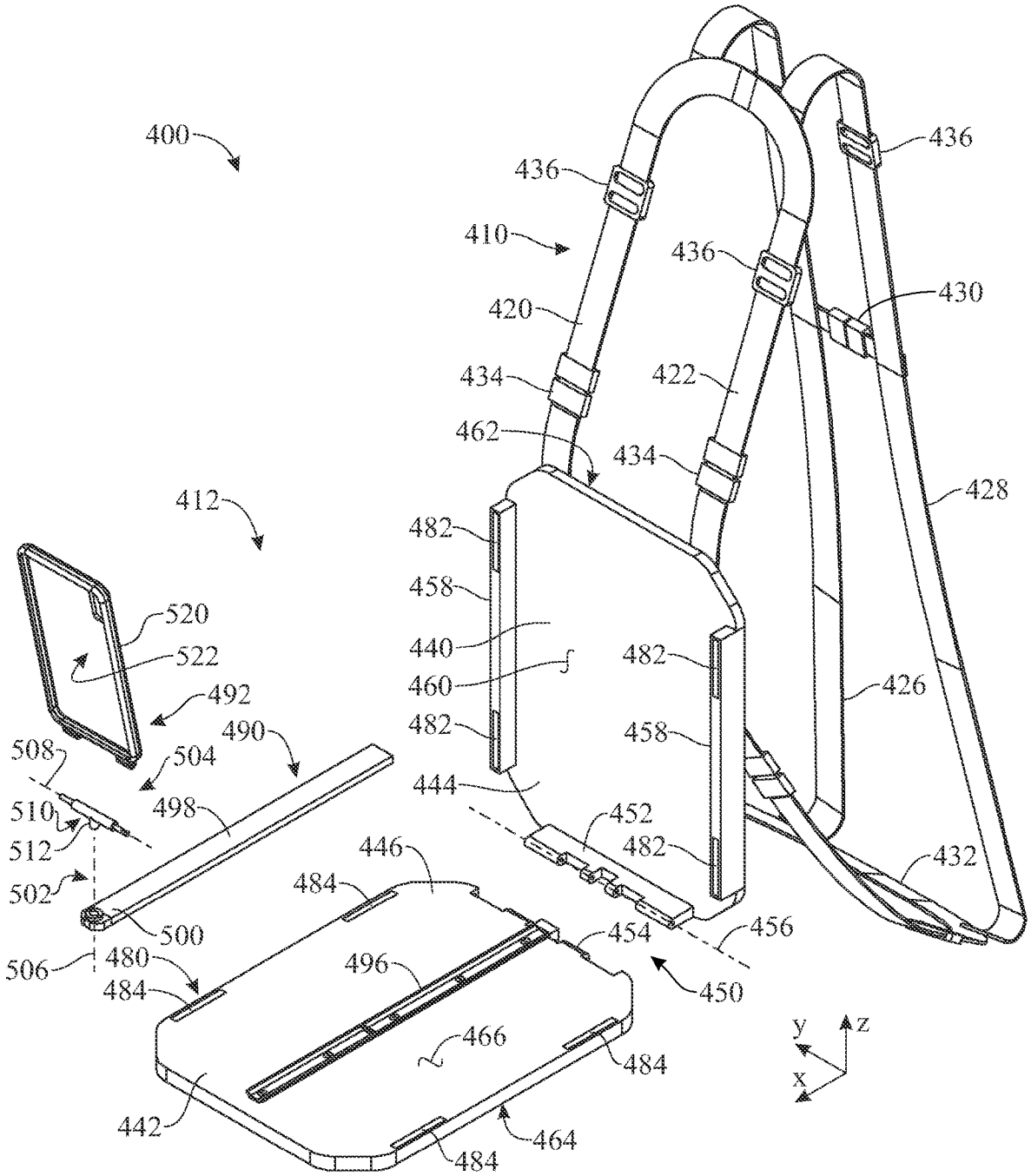
FIG. 16 presents an exploded, top front isometric view of the support assembly of FIG. 15.
Figure 20:
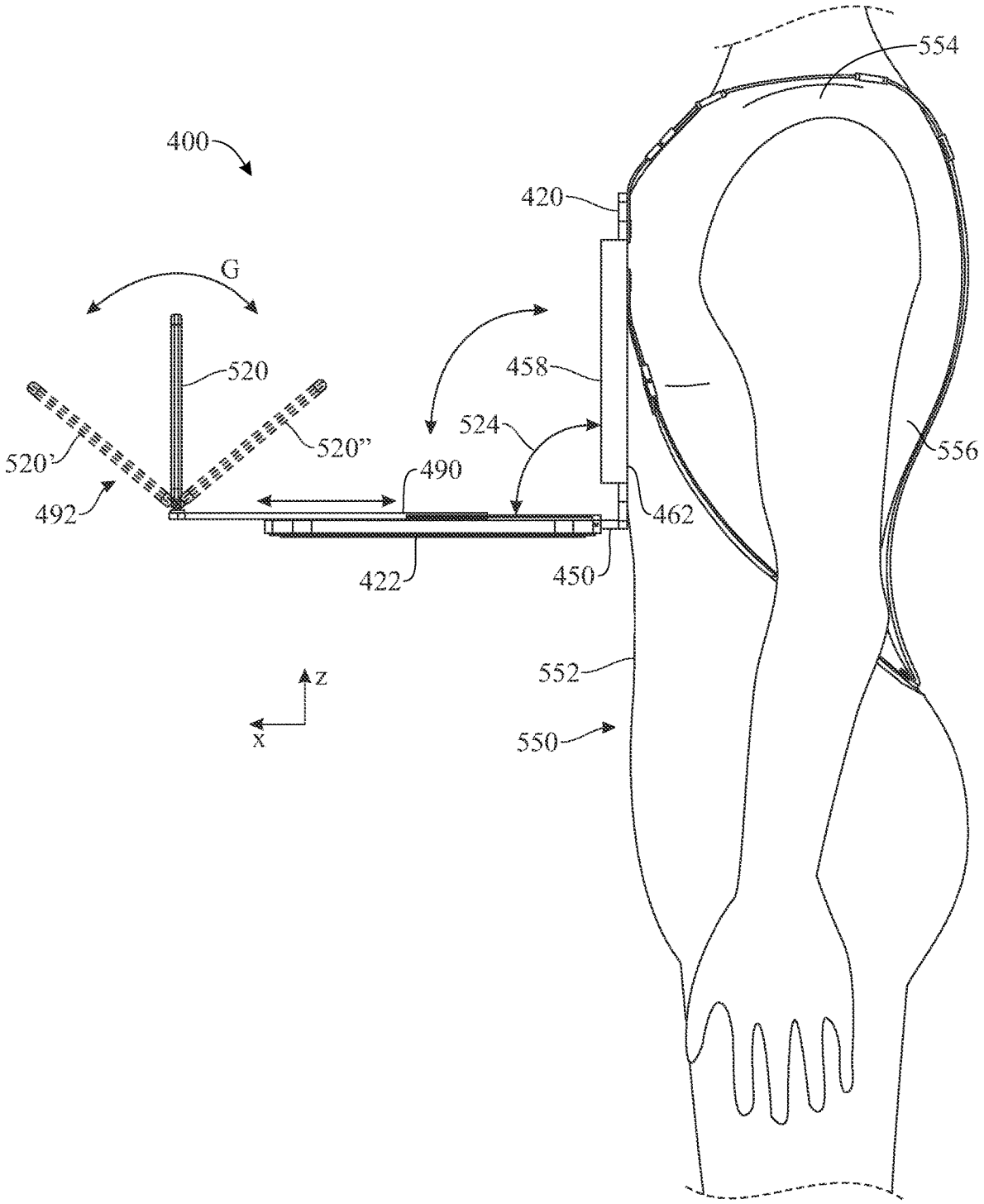
FIG. 20 presents a side elevation view of the support assembly of FIG. 15, with the arm extended outward, and showing different rotational positions of the electronic device mount relative to the arm and about a transverse rotation axis.

As shown in FIGS. 15 and 16, the harness assembly 410 may include a front left strap segment 420 and a front right strap segment 422 extending from the support structure 412 in spaced-apart configuration from one another. A connecting strap segment 424 may extend from and interconnect the front left and right strap segments 420, 422. The front left, front right, and connecting strap segments 420, 422, 424 may jointly form an inverted U-shape, as shown, the U-shape configured to extend over and preferably at least partially rest on the user's body 552. The harness assembly 410 may further include rear left and right straps segments 426 and 428, respectively, which may be arranged in spaced-apart relationship and extend from the inverted U-shape (for example, from the connecting strap segment 424) to the support structure 412. In the non-limiting example shown in the drawings, the rear left and right strap segments 426 and 428 are configured to extend over the user's shoulders 554 and along the user's back 556 (FIG. 20), and to at least partially rest on the shoulders 554 and back 556. A first counterforce member 430 and a second counterforce member 432 may be arrangeable on the user's back 556, such as by having the first and second counterforce members 430 and 432 secured to the rear left and right strap segments 426 and 428. For instance, in the specific example shown in the drawings, each one the first and second counterforce members 430 and 432 is formed as a respective strap segment extending from and between the rear left and right strap segments 426 and 428. Such a configuration prevents the rear left and right strap segments 426 and 428 from separating from one another during use, thereby allowing the rear left and right strap segments 426 and 428 and first and second counterforce members 430 and 432 to remain in place on the user's back 556 and counteract the weight of the support structure 412 and other components carried thereon or attached thereto, on the front side of the user's body 552 (FIG. 20). In some embodiments, the harness assembly 410 may include one or more buckles 434 facilitating disconnecting separating the strap members and donning or removing the harness assembling on or from the user's body 552, respectively. Alternatively or additionally, the harness assembly 410 may be provided with one or more length adjustment mechanisms 436 allowing the harness assembly 410 to be resized and adjusted to the user's body 552.

With continued reference to FIGS. 15 and 16, the support structure 412 of the present embodiment includes a first panel 440 and a second panel 442 pivotably carried by the first panel 440. The first and second panels 440 and 442 may be, more specifically, pivotably connected to one another at a respective bottom end 444, 446 of each panel 440, 442. In some embodiments, the first and second panels 440, 442 may be pivotably connected to one another by a hinge 450. The hinge 450 may include a first hinge member 452 and a second hinge member 454, which may be carried by or integrally formed with the first panel 440 and second panel 442, respectively. The hinge 450 defines a rotation axis 456 of the first panel 440 relative to the second panel 442. The hinge 450, first panel 440 and second panel 442 may be constructed such that the bottom end 446 of the second panel 442 is arranged frontward of the first panel 440 (along the front-to-back or longitudinal direction x). At least one stop, such as, but not limited to, two stops 458 may be provided to limit an upward pivoting of the second panel 442 towards the first panel 440, for purposes that will be described hereinafter. In some embodiments, such as the present embodiment, the stop(s) 458 may be provided on the first panel 440, such as in the form of two side flanges which protrude frontward from respective transverse outer edges of an outer side 460 of the first panel 440, as best shown in FIG. 16.

Figure 17:
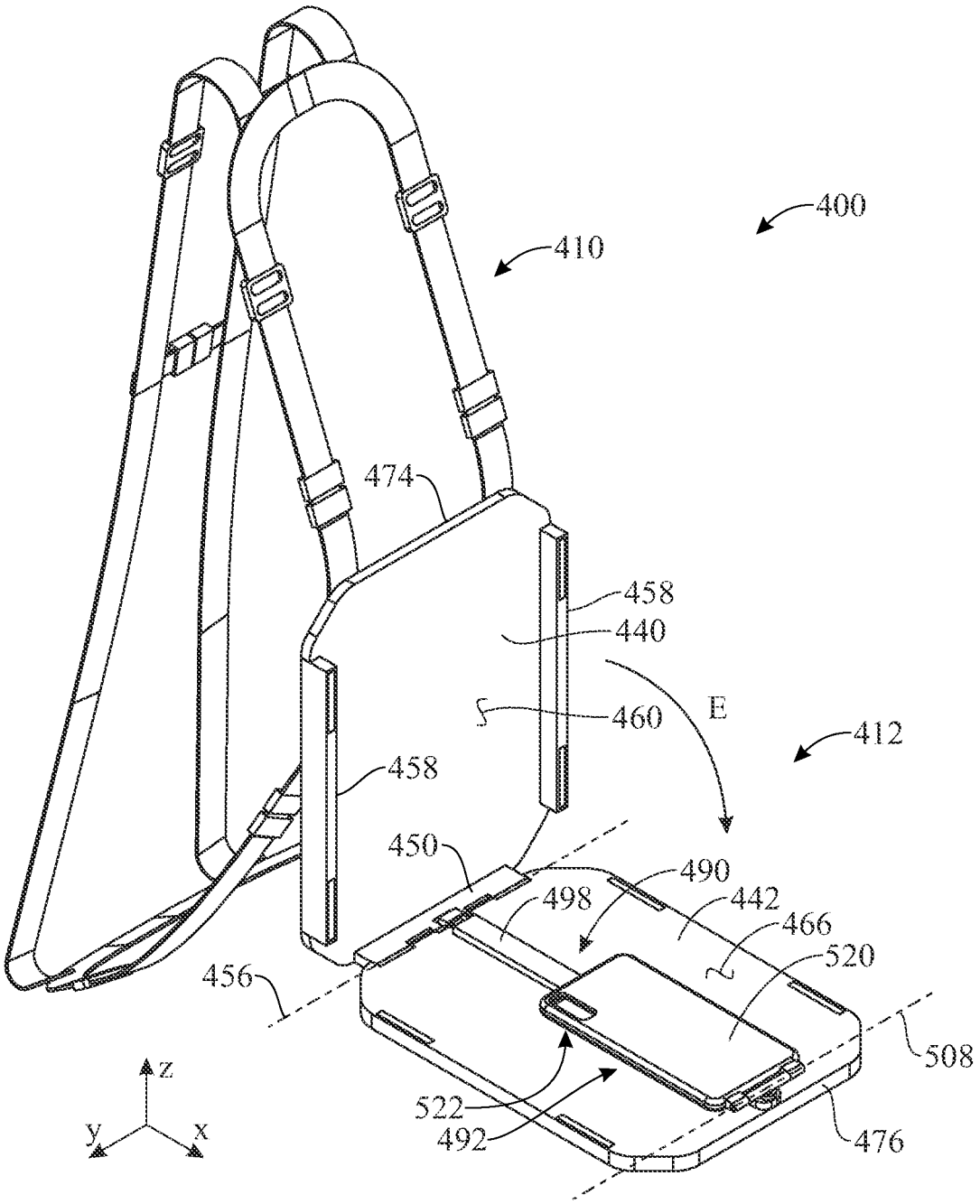
FIG. 17 presents a top, front isometric view of the support assembly of FIG. 15, with the second panel pivoted to an open position with respect to the position of FIG. 15.

As shown in FIGS. 15 and 17, the second panel 442 is pivotable between a closed position and an open position. In the closed position, shown in FIG. 15, the second panel 442 is pivoted upward and towards the second panel 442, about rotation axis 456. An inner side 466 (FIG. 16) of the second panel 442 faces and is adjacent to an outer side 460 (FIG. 16) of the first panel 440. The inner side 466 of the second panel 442 and outer side 460 of the first panel 440 are maintained in a spaced-apart, generally parallel relationship by the hinge 450 and the stops 458, such that an internal space or gap 470 is defined between the first and second panels 440, 442. The gap 470 may be gap shaped and sized to store one or more items. As best shown in FIG. 15, a top opening 472 may be defined between a top end 474 of the first panel 440 and a top end 476 of the adjacent, second panel 442. The top opening 472 may be in spatial communication with the gap 470. In the open position, as shown in FIG. 17, the second panel 442 is instead pivoted downward and away from the first panel 440 about the rotation axis 456, and extends frontward of the second panel 442. In some embodiments, with the second panel 442 arranged in the open position, the second panel 442 may form about 90 degrees with the first panel 440, as shown. However, alternative angles are contemplated without departing from the scope of the present disclosure. For example, the second panel 442 in the open position may form an acute angle with the first panel 440 such that the inner side 466 of the second panel 442 is slightly sloped downward towards the bottom end 446 of the second panel 442, contributing to retain an item placed on the inner side 466 of the second panel 442 by gravity.

In some embodiments, at least one fastener 480 may retain the second panel 442 in the closed position. The at least one fastener 480 may include one or more first fastener members 482 on the first panel 440 and one or more second fastener members 484 on the second panel 442. The first fastener members 482 may be configured to disconnectably attach to the second fastener members 484 to releasably secure the second panel 442 to the first panel 440. In non-limiting examples, the fastener members 482, 484 may include one or more of a magnet, a snap fastener, a clip, or a frictional fitting.

As shown for instance in FIGS. 16 and 17, the support structure 412 may further include an arm 490 and an electronic device mount 492 carried by the arm 490. The arm 490 may be pivotable relative to the first panel 440, together with or independently from the second panel 442. For instance, the arm 490 of the present drawings is specifically pivotable relative about the rotation axis 456 jointly with the second panel 442. In some embodiments, such as the present embodiment, the arm 490 may extend from the hinge 450 which pivotably connects the first panel 440 and the second panel 442.

In preferred embodiments, as shown, the arm 490 may be arranged between the first and second panels 440, 442, such that, as the second panel 442 is pivoted from the open position (FIG. 17) to the closed position (FIG. 15), the arm 490 becomes 'sandwiched' or received between the first and second panels 440 and 442.

In some embodiments, such as the present embodiment, the arm 490 may be extendable and retractable. For example, in the present embodiment, the arm 490 specifically includes a first arm portion 496 and a second arm portion 498 slidably extendable and retractable along the first arm portion 496. The first arm portion 496 may be attached to the second panel 442, such as to the inner side 466 of the second panel 442, and the second arm portion 498 may be slidably carried by the first arm portion 496. In other embodiments, the arm 490 may be telescopic, flexible (e.g., a gooseneck-type arm), or present alternative constructions which allow the arm 490 to be extended and retracted relative to the second panel 442 as will be described hereinafter.

In some embodiments, such as the present embodiment, the electronic device mount 492 may be carried by the arm 490 at a distal end 500 of the arm 490. Alternatively or additionally, the electronic device mount 492 may be movably connected to the arm 490, allowing a user to reorient the electronic device mount 492 (and thus an electronic device supported thereon) in different orientations relative to the user. For example, the electronic device mount 492 may be connected to the arm 490 by at least one articulated connection; in a non-limiting example, the electronic device mount 492 of the present embodiment is connected to the arm 490, specifically, by first and second articulated connections 502 and 504 defining respective rotation axes 506 and 508. The first articulated connection 502 is provided between the distal end 500 of the arm 490 and a stem 512 of a T-shaped connecting member 510. The second articulated connection 502 is provided between protruding transverse pins 514 of the connecting member 510 and an electronic device support 520. The electronic device support 520 may be a case, panel, clamp or other structure configured for the connection thereto of an electronic device, such that the electronic device 520 carries the electronic device. For example, the electronic device support 520 shown herein is formed as an electronic-device-embracing case having an open front side 522 for the insertion of an electronic device. Typically, the electronic device will be inserted with a screen or other user interface of the electronic device facing outward at the open front side 522.

An illustrative sequence of operation of the support assembly 400 will now be described with reference to FIGS. 15 and 17-20. As shown in FIG. 15, the support assembly 400 may be initially arranged with the second panel 442 pivoted to the closed position, with an outer panel 464 of the second panel 442 facing distally or frontward. The arm 490 may be retracted, and the electronic device mount 492 may be pivoted about the transverse rotation axis 508 towards and against, or adjacent to, the arm 490. An electronic device may be carried by the electronic device support 520. The retracted arm 490, undeployed electronic device mount 492, and electronic device may be located within the gap 470 defined between the outer side 460 of the first panel 440 and the inner side 466 of the second panel 442. The top opening 472 may be arranged in vertical registration with the electronic device mount 492, and preferably above the electronic device mount 492 such that the electronic device mount 492 is positioned entirely inside the gap 470.

From the initial situation of FIG. 15, and as shown in FIG. 17, the user may pivot the second panel 442 downward about rotation axis 456, as indicated by arrow E, to the open position described heretofore. In different embodiments and as described heretofore, in the open position of the second panel 442, also shown in FIG. 20, the angle 524 formed between the first and second panels 440, 442 may be about 90 degrees, or less than 90 degrees, for instance and without limitation. The hinge 450 and/or other areas of the support structure 412 may be configured to block a further downward rotation of the second panel 442 from the open position, about rotation axis 456. As further shown in FIG. 17, in some embodiments, the arm 490 and electronic device mount 492 may be pivoted downward about the rotation axis 456 jointly with the second panel 442. The pivoting actions may be easily and conveniently carried out by the user wearing the support assembly 400. The electronic device may be safely supported by the electronic device mount 492 during manipulation. The open front side 522, and thus the electronic device screen, may be safely positioned facing the arm 490 and preferably somewhat spaced-apart from the arm 490 while pivoting the front panel 442 to the open position.

Figure 18:
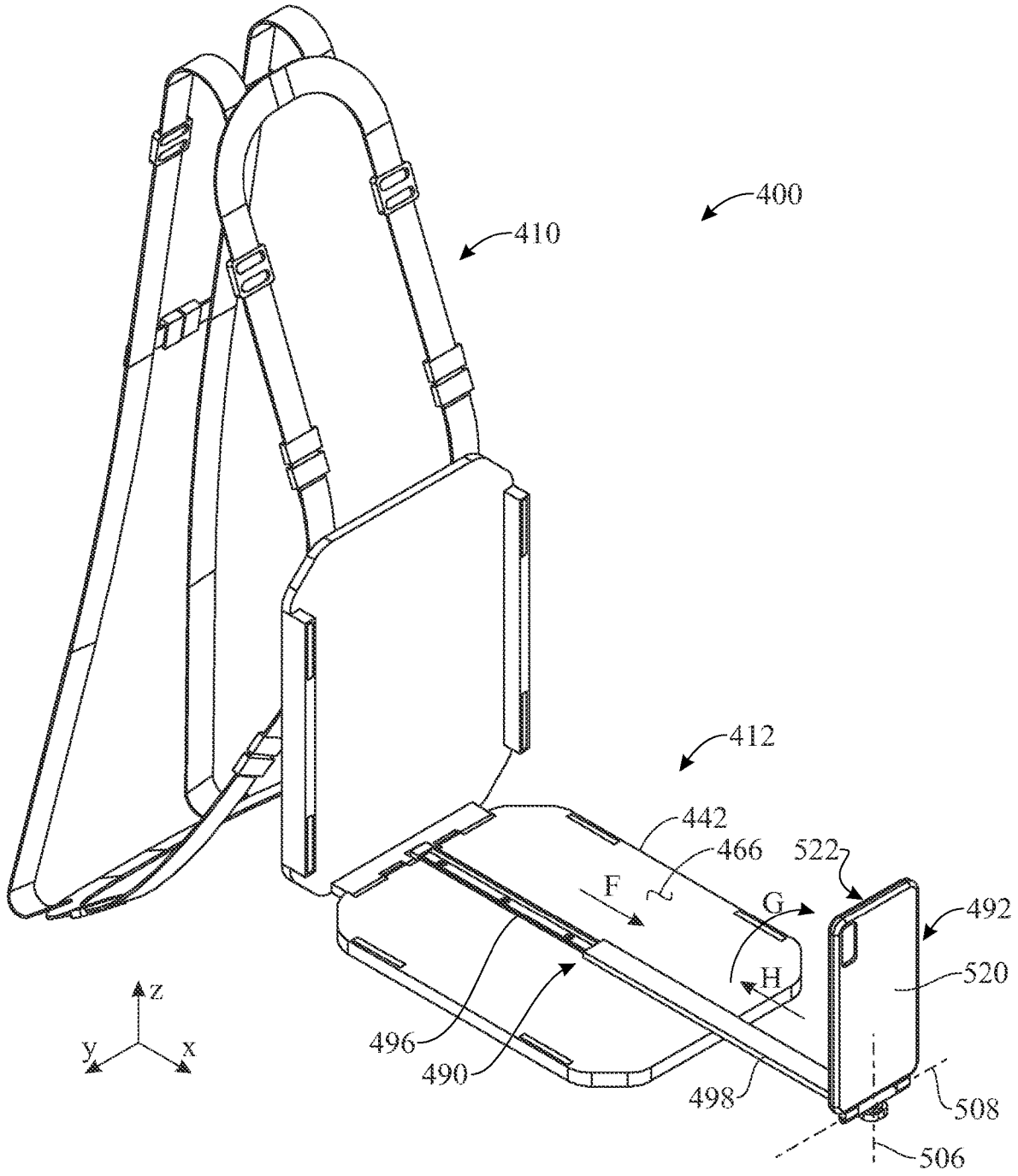
FIG. 18 presents a top, front isometric view of the support assembly of FIG. 15, with an arm carrying the electronic device mount shown extended outward, and the electronic device mount shown pivoted upward with respect to the position of FIG. 17.

From the open position shown in FIG. 17, and as shown in FIG. 18, the user may extend the arm 490 by sliding the second arm portion 498 distally or longitudinally outward along the first arm portion 496, as indicated by arrow F, to increase the distance between the electronic device mount 492 and the first panel 440. The user may then pivot the electronic device support 520 upward about transverse rotation axis 508, as indicated by arrow G, to a selected orientation or angle. For example, the illustration of FIG. 18 shows the electronic device support 520 pivoted about 90 degrees upward and with the open front side 522 of the electronic device support 522 facing towards the first panel 440, as indicated by arrow H. Alternatively, the user may select different angular adjustments or positions of the electronic device support 520 (for example, positions 520' and 520" shown in phantom lines in FIG. 20), by rotating the electronic device support 520 accordingly about the transverse rotation axis 508. With the open front side 522 of the electronic device support 520 facing rearward, the user may directly view the electronic device screen such as to hold a video call, take a self-portrait or 'selfie', manipulate tactile controls provided on the screen, or otherwise operate the electronic device.

Figure 19:
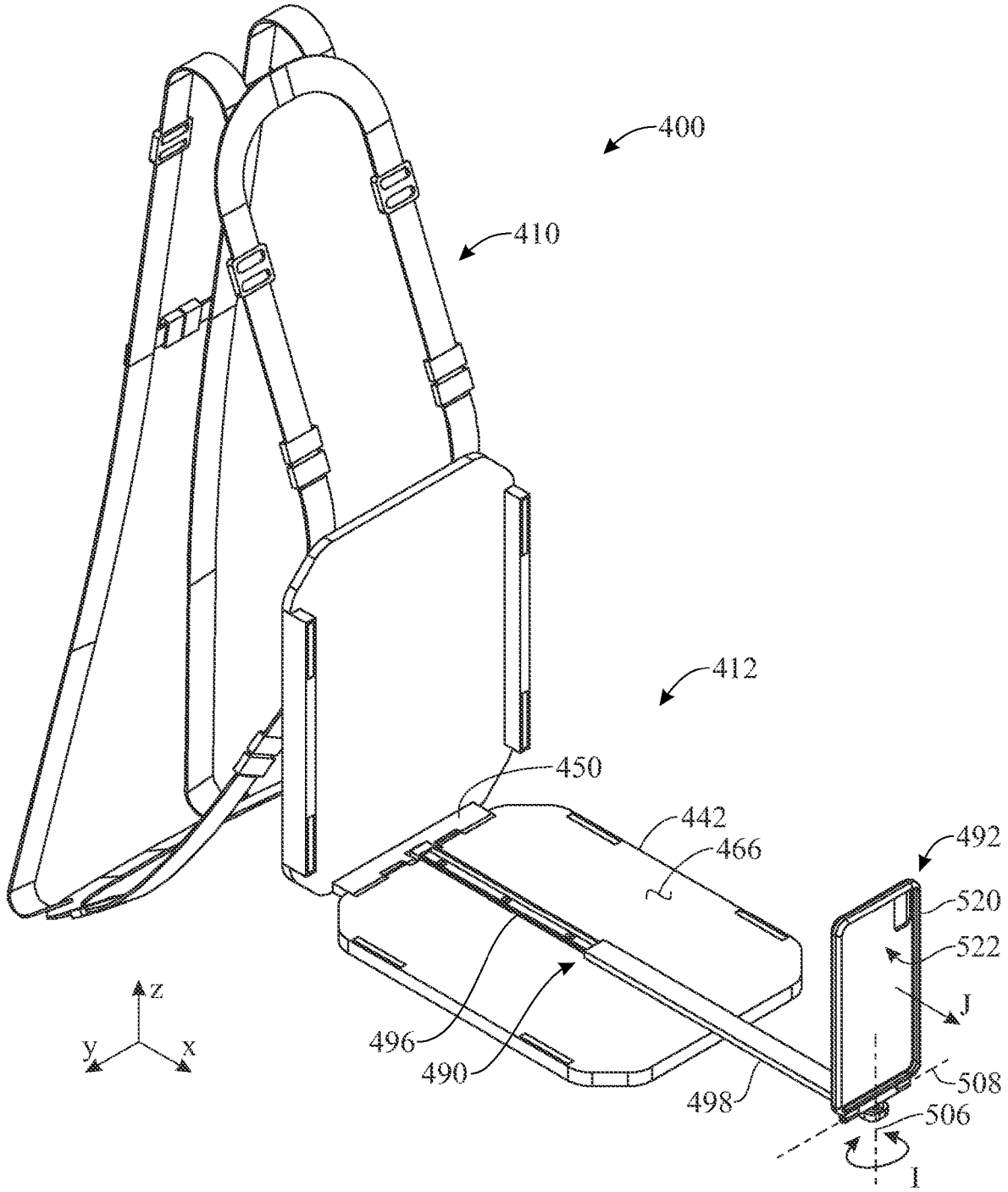
FIG. 19 presents a top, front isometric view of the support assembly of FIG. 15, with the electronic device mount rotated 180 degrees to face frontward, oppositely to the position of FIG. 18.

As shown in FIG. 19, the support assembly 400 may be further adjusted by pivoting the electronic device support 520 about rotation axis 506, as indicated by arrow I. For instance and without limitation, the user may rotate the electronic device support 520 to face sideways, forward, or diagonally with respect to the user. In the specific example of operation shown in the figure, the electronic device support 520 is illustrated pivoted 180 degrees from the position of the previous figure, such that the open front side 522 of the electronic device support 520 faces frontward or distally, as indicated by arrow J. In this position, the screen of an electronic device carried by the electronic device support 520 would face frontward (arrow J), facilitating a hands-free orientation of the device towards in front of the user for purposes such as, but not limited to, showing an environment during a video call.

In different usage positions, such as those shown in FIGS. 15 and 17-20, the user 550, via the harness assembly 410, may carry the support structure 412 and items supported thereon without using his or her hands. The support structure 412 extends generally frontward of the harness assembly 410 and body of the user, with the electronic device conveniently positionable in a wide variety of positions. As shown in FIG. 20, when the user is wearing the support assembly 400, the first panel 440, and more specifically, an inner side 462 of the first panel 440, may rest on the user's body. The first and second counterforce members 430, 432, and rear left and right strap segments 426, 428, may abut against the back 556 of the user 550 and may counteract the weight of the support structure 412 and electronic device or other item supported thereon to maintain the position of the support structure 412 and electronic device or other item supported thereon.

Furthermore, in the different usage positions in which the second panel 442 is in the open position, such as those shown in FIGS. 17-20, the inner side 466 of the second panel 442 may provide a coplanar support for stably resting an electronic device or other item thereon. For example, the user may place a phone, mouse, tablet, or other device on the inner side 466. In some embodiments, the coplanar support or inner side 466 may be arranged along a generally horizontal plane, such as when the second panel 442 is arranged at 90 degrees with the first panel 440.

After use, the support assembly 400 of the present embodiment may be operated by carrying out a generally inverse sequence, and adjusted back to the initial position of FIG. 15. In this position, the support assembly 400 may be conveniently worn by the user without hindering the user's arm movements. In addition, the user may choose to place other items (e.g., keys, a wallet, etc.) in the gap 470 through the top opening 472, for safe and temporary storage. Alternatively or additionally, the user exert an upward force on the electronic device support 520 to extend the arm 490 and pull the electronic device support 520 and electronic device out of the gap 470 through the top opening 472. With the electronic device protruding outward and still carried by the arm 490, and then pivoting the electronic device support 520 frontward about the transverse rotation axis 508, the user may rapidly position the electronic device screen (at the open front side 522) facing the user's face and easily and conveniently operate the electronic device without opening the second panel 442. In another example of use, once the electronic device support 520 has been pulled out through the top opening 472, the user may remove the electronic device from the electronic device support 520 for separate storage, transportation or use, and once more position the electronic device support 520 back into the gap 470 by carrying out an inverse sequence. In yet another example of use, once the electronic device support 520 has been pulled out through the top opening 472, the user may disconnect the electronic device support 520 from the arm 490, such as to use the electronic device support 520 as a regular electronic device case; once the electronic device support 520 has been disconnected, the arm 490 may be retracted back into the gap 470.

Thus, the support assembly 400 provides an easy-to-operate, convenient, and versatile solution for carrying electronic devices and other items hands-free, with the electronic devices readily available for use.

Alternative embodiments are contemplated without departing from the scope of the present disclosure. For example, it is contemplated that any one of the disclosed support structures may be used in combination with any one of the disclosed harness assemblies.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A wearable, support assembly, suitable to be fastened to a user's body to hold or support an electronic device or other item in a functional position for the user, the support assembly comprising:

a harness assembly configured to be selectively fastened to a body of a user; and a support structure carried by the harness assembly, the support structure comprising:

a first panel and a second panel pivotably carried by the first panel, the second panel pivotable between a closed position in which the second panel is pivoted upward and an inner side of the second panel faces and is adjacent to an outer side of the first panel and an open position in which the second panel is pivoted downward and away from the first panel, an extendable and retractable arm, arranged between the first and second panels and pivotable relative to the first panel, and an electronic device mount carried by the arm; wherein the support assembly is selectively positionable in:

a first configuration, in which the harness assembly is fastened to the body of a user and carries the support structure on a front side of the body of the user, and the second panel is arranged in the open position with the inner side of the second panel providing a support for stably resting an electronic device or other item thereon, wherein the support is arranged in a plane, and further in which the arm is extended outward and frontward of the second panel and carries the electronic device mount frontward of the second panel, and a second configuration, in which the second panel is arranged in the closed position and a gap is provided between the first and second panels, and further in which the arm is retracted, and the arm and the electronic device mount are entirely received within said gap, and further in which the gap is configured to receive an electronic device mounted on the electronic device mount.

2. The support assembly of claim 1, wherein, in the first configuration of the support assembly, the support is arranged along a generally horizontal plane.

3. The support assembly of claim 1, wherein, in the first configuration of the support assembly, the support is adjustably positionable relative to the harness assembly.

4. The support assembly of claim 1, wherein the support structure is formed along a front-to-back longitudinal direction and a left-to-right transverse direction, and further wherein, in the first configuration of the support assembly, the support structure extends generally frontward of the harness assembly and body of the user.

5. The support assembly of claim 1, further comprising a counterforce member configured to abut against a back of the user, the counterforce member configured to counteract the weight of the support structure and electronic device or other item supported thereon in the first configuration of the harness assembly to maintain a position of the support structure and electronic device or other item supported thereon.

6. The support assembly of claim 1, wherein, in the first configuration of the support assembly, the first panel rests on the user's body.

7. The support assembly of claim 1, wherein, in the open position, the second panel forms about 90 degrees with the first panel.

8. The support assembly of claim 1, wherein the first and second panels are pivotably connected to one another by a hinge, and further wherein the arm extends from the hinge.

* * * * *